US008857329B2

(12) United States Patent
Miyake et al.

(10) Patent No.: US 8,857,329 B2
(45) Date of Patent: Oct. 14, 2014

(54) SCREEN PRINTING APPARATUS

(75) Inventors: Yasushi Miyake, Shizuoka (JP); Takeshi Fujimoto, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 88 days.

(21) Appl. No.: 13/483,770

(22) Filed: May 30, 2012

(65) Prior Publication Data

US 2012/0304876 A1 Dec. 6, 2012

(30) Foreign Application Priority Data

May 31, 2011 (JP) ..... 2011-122926

(51) Int. Cl.

| | |
|---|---|
| ***B41F 15/00*** | (2006.01) |
| ***B41F 15/08*** | (2006.01) |
| ***B41F 15/12*** | (2006.01) |
| ***B41F 15/26*** | (2006.01) |
| ***B41F 15/46*** | (2006.01) |
| ***B41F 15/36*** | (2006.01) |
| ***B41F 15/42*** | (2006.01) |

(52) U.S. Cl.

CPC ..... *B41F 15/0881* (2013.01); *B41P 2215/114* (2013.01); *B41F 15/26* (2013.01); *B41F 15/46* (2013.01); *B41F 15/36* (2013.01); *B41F 15/423* (2013.01); *B41P 2215/50* (2013.01); *B41P 2215/12* (2013.01); *B41P 2215/112* (2013.01)

USPC ..... 101/123; 101/126; 101/129

(58) Field of Classification Search

CPC ..... B41F 15/423; B41P 2215/12; B41P 2215/114

USPC ..... 101/114, 123, 124, 126, 129

See application file for complete search history.

(56) References Cited

U.S. PATENT DOCUMENTS

| | | | |
|---|---|---|---|
| 5,176,078 | A | 1/1993 | Homma et al. |
| 5,730,051 | A | 3/1998 | Takahashi et al. |

(Continued)

FOREIGN PATENT DOCUMENTS

| | | | |
|---|---|---|---|
| EP | 2 039 511 | A1 | 3/2009 |
| JP | 07-205399 | A | 8/1995 |

(Continued)

OTHER PUBLICATIONS

The extended European Search Report dated Oct. 11, 2012; EP Application No. 12004141.3-2304.

The first Office Action issued by the State Intellectual Property Office of People's Republic of China on Dec. 20, 2013, which corresponds to Chinese Patent Application No. 201210162661.5 and is related to U.S. Appl. No. 13/483,770; with English language summary.

*Primary Examiner* — Ren Yan
*Assistant Examiner* — Marissa Ferguson Samreth
(74) *Attorney, Agent, or Firm* — Studebaker & Brackett PC

(57) ABSTRACT

A screen printing apparatus includes a printing execution unit that performs screen printing on a substrate. At least one substrate support table that is provided movably along a specific direction orthogonal to the conveying direction. A table drive mechanism that moves the substrate support table at least between substrate entry and exit positions along a specific direction. The substrate entry and exit positions are set asymmetrically with respect to the specific direction. A printing execution unit drive mechanism is provided to drive the printing execution unit along the specific direction. A control unit is provided to control the printing execution unit drive mechanism so that the printing execution unit is driven to set the printing position on a substrate conveying path needed for the substrate support table to move from the substrate entry to the substrate exit.

8 Claims, 29 Drawing Sheets

(56) References Cited

U.S. PATENT DOCUMENTS

| | | | | |
|---|---|---|---|---|
| 6,066,206 | A * | 5/2000 | Doyle et al. | 427/98.5 |
| 6,663,712 | B2 * | 12/2003 | Doyle et al. | 118/301 |
| 7,219,787 | B2 * | 5/2007 | Kabeshita et al. | 198/346.2 |
| 2010/0242755 | A1 * | 9/2010 | Nagao | 101/126 |
| 2012/0085253 | A1 | 4/2012 | Nagao | |
| 2012/0085254 | A1 | 4/2012 | Nagao | |

FOREIGN PATENT DOCUMENTS

| | | | | |
|---|---|---|---|---|
| JP | 2005-081745 | * | 3/2005 | B41F 15/12 |
| JP | 2009-070867 | A | 4/2009 | |
| WO | 2009/035136 | A1 | 3/2009 | |

* cited by examiner

SCREEN PRINTING APPARATUS

BACKGROUND OF THE INVENTION

1. Field of the Invention

The present invention relates to a screen printing apparatus, and more particularly to a screen printing apparatus that screen-prints a cream solder, an electrically conductive paste, or the like on a substrate, such as a printed wiring board (PWB), as preprocessing for mounting electronic components on the substrate.

2. Description of the Related Art

A screen printing apparatus is installed in a printed circuit board (PCB) manufacturing line, as described in Japanese laid-open Publications, for example, H7-205399. The screen printing apparatus performs screen printing of an electrically conductive paste or the like on substrates conveyed from the upstream side, and delivers the substrates after printing to a component mounting apparatus located on the downstream side. In most screen printing apparatus of this type, a single printing unit installed in the apparatus receives the substrates one by one, and delivers, upon performing the printing processing thereon, to the component mounting apparatus. Therefore, the path of the substrates conveyed to and from the screen printing apparatus is set in the center of the screen printing apparatus, and the printing position at which the screen printing is performed is fixedly set at a center position on the substrate conveying path.

However, a demand has recently grown for a configuration in which a substrate support table that supports the substrates can move in a specific direction orthogonal to the substrate conveying direction and which is imparted with a switching function for switching the conveying path of the substrate on the substrate support table in the specific direction orthogonal to the conveying direction. However, if the printing position is fixedly set to the center position on the substrate conveying path, then such configuration can cause a problem that the substrates is required to pass undesirable routes, thereby decreasing the throughput.

SUMMARY OF THE INVENTION

The present invention has been made to resolve the above-described problem.

It is an object of the present invention to provide a screen printing apparatus in which throughput can be increased by using a substrate conveying table adapted to be movable along a direction orthogonal to a direction in which the substrates are conveyed or delivered.

In order to attain the abovementioned object, the present invention provides a screen printing apparatus that receives a substrate conveyed along a predetermined conveying direction from a substrate entry position. The screen printing apparatus then performs screen printing on the substrate, and deliver the printed substrate from a substrate exit position that is set on a downstream side in the conveying direction. The screen printing apparatus may includes: a printing execution unit that performs screen printing on the substrate; at least one substrate support table that is provided movably along a specific direction orthogonal to the conveying direction, the substrate support table holds the substrate delivered from the substrate entry position, provides the substrate for printing processing at a printing position that is set by the printing execution unit, and deliveries the substrate after printing from the substrate exit position; and a table drive mechanism that moves the substrate support table at least from the substrate entry position to the substrate exit position along the specific direction in a reciprocating manner. In the screen printing apparatus, the substrate entry and exit positions are set asymmetrically with respect to an apparatus center axis along the specific direction. A printing execution unit drive mechanism is provided to drive the printing execution unit along the specific direction. A control unit is provided to control the printing execution unit drive mechanism so that the printing execution unit is driven to set the printing position on a substrate conveying path needed for the substrate support table to move from the substrate entry to the substrate exit.

According to the aforementioned configuration, even though the substrate entry position and substrate exit position are set asymmetrically with respect to the apparatus center line along the specific direction, the printing process can be executed on the substrate conveying path needed for the substrate support table to move from the substrate entry position to the substrate exit position. Therefore, the movement distance is shorter than that in the case where the printing position is at the center of the apparatus. As a consequence, the entire movement path of the substrate support table in the specific direction is shortened and a contribution can be made to the increase in throughput. Furthermore, the printing position can be adjusted as necessary by moving the printing execution unit along the specific direction. As a result, the printing position can be changed according to the layout of substrate entry position or substrate exit position, or operation mode of the substrate support table, so that the printing process can be implemented with higher efficiency.

These and other objects, features and advantages of the present invention will become more apparent upon reading the following detailed description along with the accompanying drawings.

DESCRIPTION OF THE PREFERRED EMBODIMENTS

The preferred mode for carrying out the present invention will be described below with reference to the appended drawings.

Figure 1:
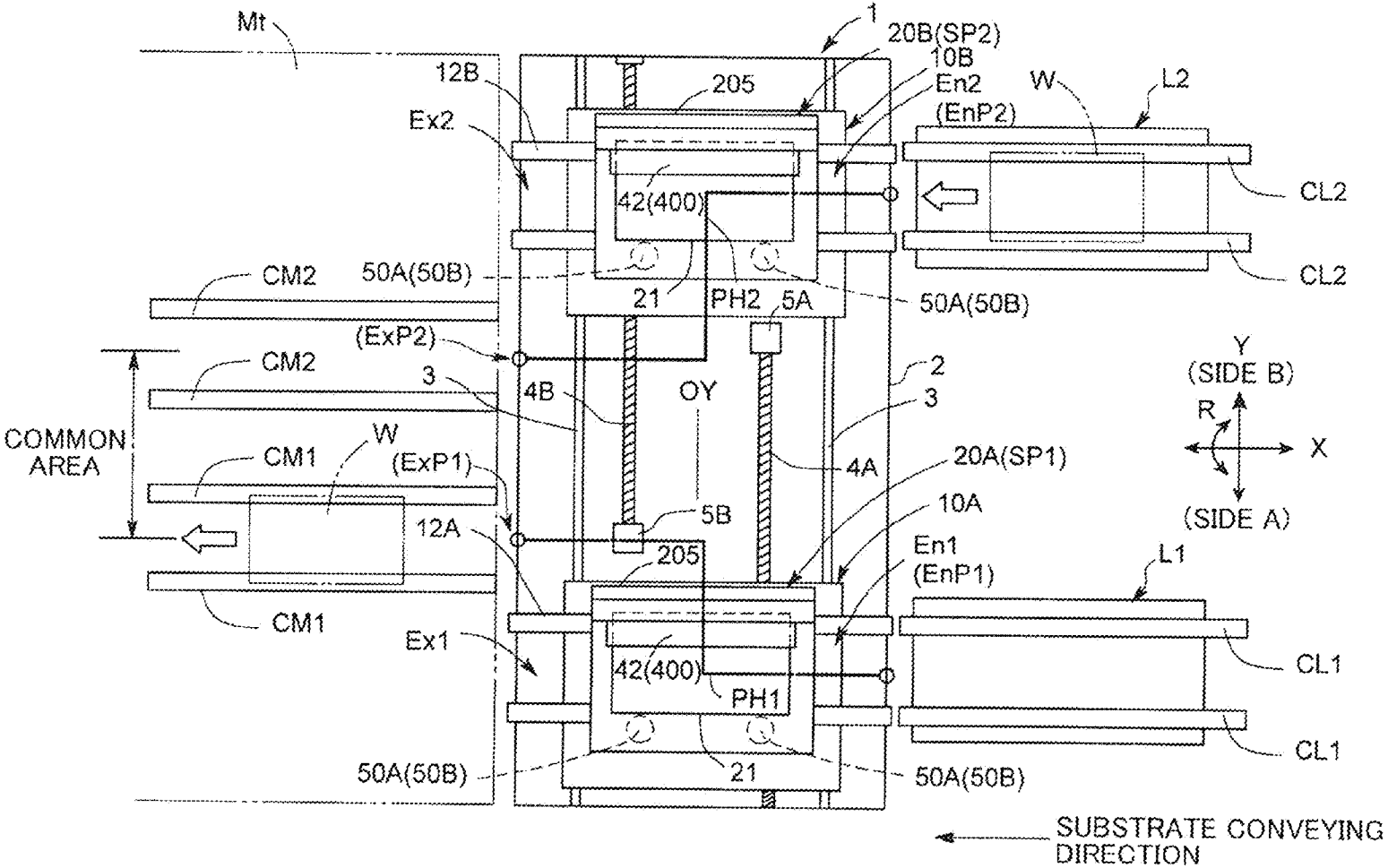
FIG. 1 is a simplified plan view of the screen printing apparatus according to an embodiment of the present invention.
Figure 2:
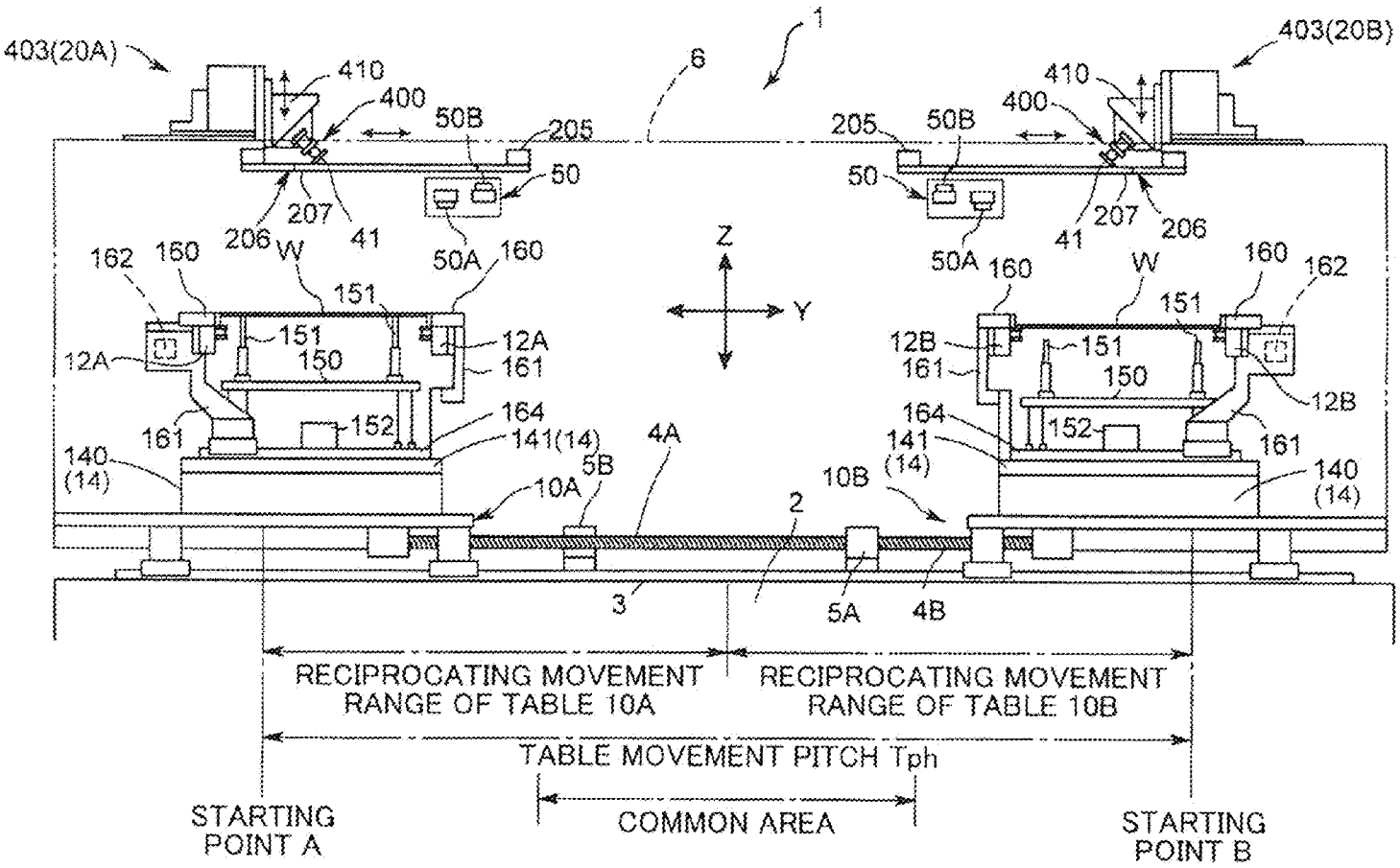
FIG. 2 is a simplified side view of the screen printing apparatus shown in FIG. 1.

Referring to FIGS. 1 and 2, a screen printing apparatus 1 according to the present embodiment is installed in a manufacturing line for printed circuit boards in a state in which the screen printing apparatus is connected on the downstream side thereof to a component mounting apparatus Mt of a dual conveying type. In the example shown in the figure, the screen printing apparatus 1 is configured to be interposed between two loaders L1, L2 (also may be referred to as a first and a second loaders L1 and L2) disposed parallel to each other and a single component mounting apparatus Mt, perform screen printing on substrates W that are fed from the upstream loaders L1, L2, and deliver the substrates to the downstream component mounting apparatus Mt.

In the explanation of the screen printing apparatus 1 below, the conveying direction of the substrate W in the manufacturing line is taken as a X axis direction, the direction orthogonal to the X axis direction on a horizontal plane is taken as an Y axis direction, and the direction (vertical direction) orthogonal to both the X axis direction and the Y axis direction is taken as a Z axis direction. In the present embodiment, the Y axis direction is an example of the "specific direction" in accordance with the present invention.

The first and second loaders L1, L2 are provided with first and second conveyor pairs CL1, CL2, respectively. Meanwhile, the component mounting apparatus Mt is provided with a belt conveyor pairs CM1, CM2 (also may be referred to as a first belt conveyor pair CM1 and a second belt conveyor pair CM2). The substrate W is conveyed along these belt conveyor pairs CL1, CL2, CM1, and CM2. In the screen printing apparatus 1, substrate entry positions EnP1 and EnP2 facing the first and second loaders L1, L2 are set on the upstream side in the substrate conveying direction, and substrate exit positions ExP1 and ExP2 facing the first and second belt conveyor pairs CM1, CM2 are also set. As shown in the figure, the substrate entry positions EnP1 and EnP2 and the substrate exit positions ExP1 and ExP2 according to the present embodiment are set asymmetrically with respect to a center line OY along the Y axis direction of the screen printing apparatus 1.

The screen printing apparatus 1 is provided with a base 2, two substrate support tables 10A and 10B (also may be referred to as first and second substrate support tables 10A and 10B) on the base 2 for supporting the substrates W, and printing execution units 20A and 20B (also may be referred to as first and second printing execution units 20A and 20B) that form a pair and are provided for each substrate support table 10A, 10B.

The substrate support tables 10A and 10B have substrate entry units En1 and En2 (also may be referred to as first and second substrate entry units En1 and En2) on the upstream end in the X axis direction and substrate exit units Ex1 and Ex2 (also may be referred to as first and a second substrate exit units Ex1 and Ex2) on the downstream end in the X axis direction. In the embodiment illustrated by the figure, the first and second substrate entry units En1 and En2 are provided at the first and second substrate entry positions EnP1 and EnP2. The screen printing apparatus 1 is configured such that the substrate W fed from the first loader L1 is conveyed from the first substrate entry unit Ent, screen printing is performed at a printing position SP1 that are set by the printing execution unit 20A, and the substrate W after the printing process is delivered from the first substrate exit unit Ex1 to the first belt conveyor pair CM1 of the component mounting apparatus Mt, whereas the substrate W fed from the second loader L2 is conveyed into the apparatus from the second substrate entry unit En2, screen printing is performed at a printing position SP2 that are set by the printing execution unit 20B, and the substrate W after the printing process is delivered from the second substrate exit unit Ex2 to the second belt conveyor pair CM2 of the component mounting apparatus Mt. Thus, in the screen printing apparatus 1, substrate conveying paths PH1, PH2 are set that are required for the movement from the substrate entry position EnP1 (EnP2) facing the loader L1 (L2) to the substrate exit position ExP2 facing the belt conveyor pair CM1 (CM2).

The substrate support tables 10A and 10B have a substantially rectangular shape (in a plan view thereof) that extends in the X axis direction and are configured so that they can be individually moved in the Y axis direction by a table drive mechanism formed by threaded shafts 4A, 4B, motors 5A and 5B, or other parts. Thus, the substrate support tables 10A and 10B are configured to be movably supported on a common fixed rail 3 provided on the base 2 and extending in the Y axis direction and to be driven by the motors 5A and 5B through the threaded shafts 4A, 4B, respectively. On the basis of motor control performed by the below-described control unit 60, the first substrate support table 10A moves among a reception position at which the substrate W fed from the first loader L1 can be received by the first substrate entry unit Ent, a delivery position at which the substrate W can be delivered from the first substrate exit unit Ex1 to the belt conveyor pair CM1 of the downstream component mounting apparatus Mt, and the printing position SP1 in which screen printing is implemented in the printing process. The second substrate support table 10B moves among a reception position at which the substrate W fed from the second loader L2 can be received by the second substrate entry unit En2, a delivery position at which the substrate W can be delivered from the second substrate exit unit Ex2 to the belt conveyor pair CM2 of the downstream component mounting apparatus Mt, and the printing position SP2 in which screen printing is implemented in the printing process. In addition, the first and second substrate support tables 10A and 10B move alternately to the printing process in the preset order. Rotary encoders are mounted on the threaded shafts 4A, 4B, and the below-described control unit 60 can obtain position information and speed information of the corresponding substrate support table 10A, 10B on the basis of detected values of the rotary encoders. In the present embodiment, a range in which either substrate support table 10A (10B) can move in the Y axis direction is called a table movement pitch Tph (see FIG. 2 and also FIGS. 13 to 15). The table movement pitch Tph is set slightly wider (see the below-described FIG. 20) than the space between the substrate entry positions EnP1 and EnP2 (and substrate exit positions ExP1 and ExP2) so that the substrate support table 10A (10B) could perform the below-described front process and rear process.

The substrate support tables 10A and 10B are, respectively, provided with belt conveyor pairs 12A and 12B extending in the X axis direction, a clamp unit 14 that holds, in a printable manner, the substrate W located on the belt conveyor pairs 12A and 12B, and a clamp unit drive mechanism for moving the clamp unit 14 in the X axis direction along the belt conveyor pairs 12A and 12B.

The belt conveyor pairs 12A and 12B are constituted by a belt conveyer. In the X axis direction, the upstream end of the belt conveyor pairs 12A on the substrate support table 10A becomes the substrate entry unit En1 and the downstream end becomes the substrate exit unit Ex1. In the X axis direction, the upstream end of the belt conveyor pairs 12B on the substrate support table 10B becomes the substrate entry unit En2 and the downstream end becomes the substrate exit unit Ext. The belt conveyor pair receives the substrate W that is fed from the first and second loaders L1 and L2 at the substrate entry units En1 and En2, conveys the substrate W from the substrate entry units En1 and En2 to the predetermined position set on the substrate support tables 10A and 10B (the above-described process is referred to as "substrate conveying process"), conveys the substrate W after the printing process to the substrate exit units Ex1 and Ex2, and then conveys the substrate from the substrate exit units Ex1 and Ex2 to the first and second belt conveyor pairs CL1, CL2 of the component mounting apparatus Mt (the above-described process is referred to as "substrate delivery process").

Referring to FIG. 2, base members 140 of the substrate support tables 10A and 10B are supported movably in the Y axis direction on the fixed rail 3, and an X table 141 is provided movably in the X axis direction with respect to the base member 140 on each base member 140. Arm members 161 that support the respective belt conveyor 12A (12B) are provided at both ends, in the Y axis direction, of the X table 141.

The clamp unit 14 is provided with a backup mechanism that is provided on the X table 141 between the two arm members 161, lifts the substrate W from the belt conveyor pair 12A, 12B and supports the lifted substrate. The clamp unit 14 is also provided with a clamp mechanism that is provided at the arm members 161 and fixes the substrate W that has been lifted up by the backup mechanism.

The backup mechanism includes a backup table 150 that is provided with a plurality of backup pins 151 of a predetermined arrangement and supported movably in the vertical direction on the X table 141 by a ball screw mechanism or the like. The backup mechanism also includes a drive motor 152 for the ball screw mechanism or the like. The backup mechanism is configured such that when the ball screw mechanism or the like is actuated by the drive of the motor 152, the backup table 150 is displaced between a predetermined release position and an operation position obtained by lifting up from this position. The release position, as referred to herein, is a position at which the distal end position of the backup pins 151 is lower than the lower surface of the substrate W supported by the belt conveyor pair 12A, 12B (position shown at the substrate support table 10B on the right side in FIG. 2), and the operation position is a position at which the distal end position of the backup pins 151 is higher than the lower surface of the substrate W (position shown at the substrate support table 10A on the left side in FIG. 2). Therefore, when the backup table 150 is placed at the operation position as shown on the left side in FIG. 2, the backup mechanism lifts the substrate W from the belt conveyor pair 12A, 12B.

The clamp mechanism includes a pair of clamp members 160 disposed at the arm members 161 at a position above the belt conveyor pair 12A, 12B and extending parallel to each other in the X axis direction. The clamp mechanism also includes an actuator for driving the clamp members, for example, a bidirectional air cylinder 162. One of the two clamp members 160 is assembled so that it can be displaced in the Y axis direction with respect to the arm member 161, and this clamp member is displaced along the Y axis direction between the release position and clamp position by the air cylinder 162. In other words, the clamp mechanism is configured such that when one of the clamp members 160 shifts from the release position to the clamp position, the substrate W that has been lifted by the backup mechanism is clamped by this clamp member together with the other clamp member 160 in the Y axis direction. When the clamp member shifts from the clamp position to the release position, then the clamped substrate W is released.

In the printing process, the below-described screen mask 206 is abutted on the substrate W that has thus been lifted from the belt conveyor pair 12A, 12B by the clamp unit 14 and clamped by the clamp members 160. The clamp unit 14 lifts the substrate from the belt conveyor pair 12A, 12B and holds the substrate in a state in which screen printing can be performed by the printing execution unit 20.

The arm members 161 are formed as if the members clasp the belt conveyor pair 12A, 12B from the outside (outside in the Y axis direction). One arm member 161 is fixed to one end portion on the X table 141, and the other arm member 161 is provided slidably along a fixed rail 164 fixed in the Y axis direction of the X table 141. By adjusting the sliding amount of the other arm member 161, it is possible to adjust the conveyor width of the belt conveyor pair 12A, 12B correspondingly to substrates W with different substrate width in the Y axis direction. Where a constant mutual arrangement of the belt conveyor pair 12A, 12B and the clamp members 160 in the Y axis direction is maintained, regardless of the conveyor width of the belt conveyor pair 12A, 12B corresponding to the substrate width in the Y axis direction, the substrate W can be accurately clamped regardless of the width of the substrate W in the Y axis direction.

Figure 3:
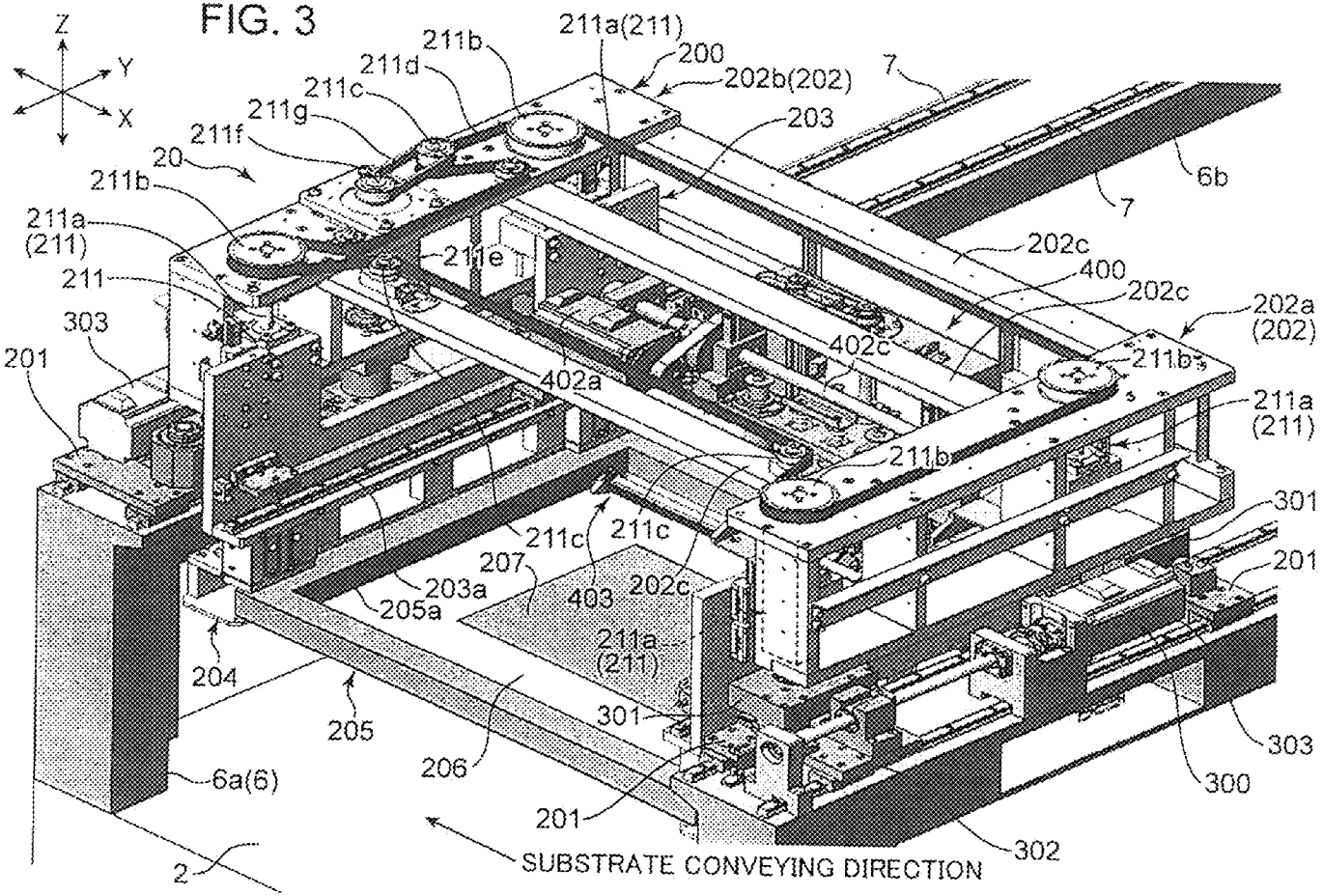
FIG. 3 is a perspective view illustrating the printing execution unit of the screen printing apparatus shown in FIG. 1.
Figure 4:
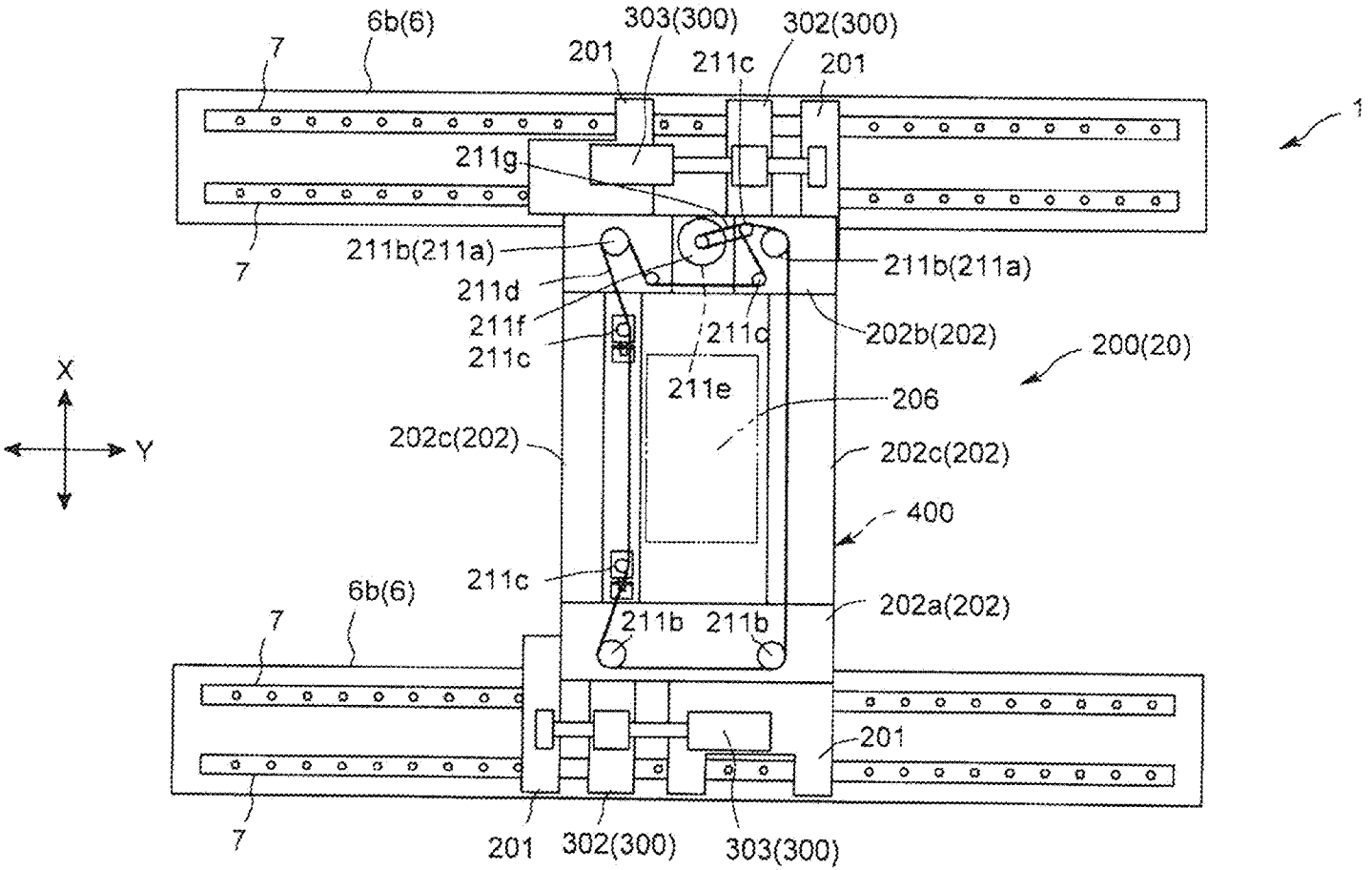
FIG. 4 is a simplified plan view illustrating the printing execution unit of the screen printing apparatus shown in FIG. 1.

Referring to FIGS. 3 and 4, an apparatus frame 6 that carries the printing execution unit 20 is disposed on the base 2. The apparatus frame 6 is a gate-like structure and has pillars 6*a* arranged vertically in the four corners of the base 2. A beam 6*b* is integrally provided with a pair of pillars 6*a* facing each other along the Y axis direction, and a set of two guide rails 7 extending in the Y axis direction are mounted on the upper surface of the beam 6*b*. In the present embodiment, the printing execution unit 20 is configured to be disposed on the guide rails 7 and be movable in a reciprocating manner along the Y axis direction. The movement range of the printing execution unit 20 corresponds to the table movement pitch Tph shown in FIG. 2.

The printing execution unit 20 is provided with a screen mask holding mechanism 200 and a squeegee unit holding mechanism 400 that arranges the screen mask holding mechanism 200 in the X axis direction.

The screen mask holding mechanism 200 is provided with sliders 201 disposed on the guide rail 7 of the apparatus frame 6, a main body 202 connected by a position adjusting mechanism 300 to the slider 201, a mask lifting unit 203 connected movably in the vertical direction to the main body 202, a clamp unit 204 provided at the lower end of the mask lifting unit 203, a mask fixing member 205 held by the clamp unit 204, and a screen mask 206 fixed to the mask fixing member 205.

The sliders 201 are disposed on one end side and the other end side in the X axis direction and form a pair. Each slider is connected to a ball screw mechanism (not shown in the figure) provided at the apparatus frame 6. The ball screw mechanism is driven by the Y axis servo motor 210 (see FIG. 10). When the slider 201 is driven by the Y axis servo motor 210 through the ball screw mechanism, the slider is moved in a reciprocating manner along the Y axis direction.

The main body 202 is a structure formed as a rectangular frame (in the plan view thereof) and integrally includes: an upstream structural body 202*a* standing on the slider 201 on the upstream side with respect to the X axis direction of the apparatus frame 6, a downstream structural body 202*b* standing on the downstream slider 201, and a beam 202*c* connecting the two structural bodies 202*a* and 202*b* along the X axis direction.

The mask lifting unit 203 is connected to the internal portion of the main body 202 by a lifting mechanism 211. The lifting mechanism 211 is provided with four ball screw mechanisms 211*a* provided in two locations on the front and rear sides of each structural body 202*a*, 202*b*, a pulley 211*b* provided at the top of each ball screw mechanism 211*a*, a plurality of idle pulleys 211*c* that are assembled at structural bodies 202*a*, 202*b* and also at the front beam 202*c*, a power transmitting belt 211*d* stretched between these pulleys 211*b*, 211*c*, and a mask Z-axis servo motor 211*e* mounted on the downstream structural body 202*b*. The torque about the vertical axis of the mask Z-axis servo motor 211*e* is transmitted from an output pulley 211*f* of the mask Z-axis servo motor 211*e* through a power transmitting belt 211*g* to the idle pulley 211*c* of the downstream structural body 202*b*, and then transmitted from the power transmitting belt 211*d* through the pulley 211*b* to the screw portion of each ball screw mechanism 211*a*. As a result, the screw portions of the ball screw mechanisms 211*a* are rotated together in the same direction, and the mask lifting unit 203 connected to the nuts screwed on the screw portions is lifted or lowered. Thus, the mask lifting unit 203 can move the screen mask 206 between a superposition position at which the screen mask 206 is superimposed on the substrate and a release position at which the screen mask 206 is lifted above the superposition position with respect to the substrate W that has been lifted up to the operation position by the substrate support table 10A (10B) positioned immediately below the mask lifting unit.

The clamp unit 204 is provided at the lower end portion of the mask lifting unit 203 and detachably clamps four corners of the mask fixing member 205. The clamp unit 204 is provided with a movable member that is driven by an air cylinder in the Z axis direction, and a fixed member that clamps together with the movable member the mask fixing member 205. In operation, the clamp unit can strongly hold the mask fixing member 205 positioned by a positioning member (not shown in the figure).

The mask fixing member 205 is realized as a rectangular frame having an opening 205*a*, formed in the center thereof, for screen printing. The pre-assembled screen mask 206 is detachably fixed to the mask fixing member, so as to close the opening 205*a*.

The screen mask 206 forms a printing area 207 having therein a plurality of Holes corresponding to the screen pattern that will be printed on the substrate W.

The position adjusting mechanism 300, connecting the sliders 201 with the main body 202, includes a plurality of connection members connecting the sliders 201 and the main body 202 by connection shafts movable along the Z axis direction, a drive member 302 that drives some of the connection members 301 about the connection shafts, and a mask Y-axis servo motor 303 that moves the drive member 302 along the Y axis direction in a reciprocating manner. The position adjusting mechanism 300 enables the main body 202 to swing about the Z axis with respect to the sliders 201. As a result, the mask Y-axis servo motor 303 is driven on the basis of the position of the substrate W and the mounting position of the screen mask 206 recognized by an image capturing unit 50, thereby making it possible to adjust finely the parallelism of the substrate W supported by the substrate support tables 10A and 10B and the printing area 207 of the screen mask 206.

The squeegee unit holding mechanism 400 spreads a paste such as a cream solder or an electrically conductive paste on the screen mask 206, while rolling (kneading) the paste. In the example shown in the figure, the squeegee unit holding mechanism 400 is laid laterally across a pair of fixed rails 203*a*, provided at the inner wall of the mask lifting unit 203 and extending in the Y' axis direction, and connected thereto so that the squeegee unit holding mechanism can move along the Y axis direction in a reciprocating manner. The Y' axis direction as referred to herein is defined in a coordinate system that has been set at the main body 202 of the screen mask holding mechanism 200, and when the rotation amount of the main body 202 of the screen mask holding mechanism 200 around an R axis is zero, this direction matches the Y axis direction in the coordinate system that has been set at the base 2. The horizontal direction orthogonal to the Y' axis direction will be referred to herein below as a X' axis direction.

Figure 5:
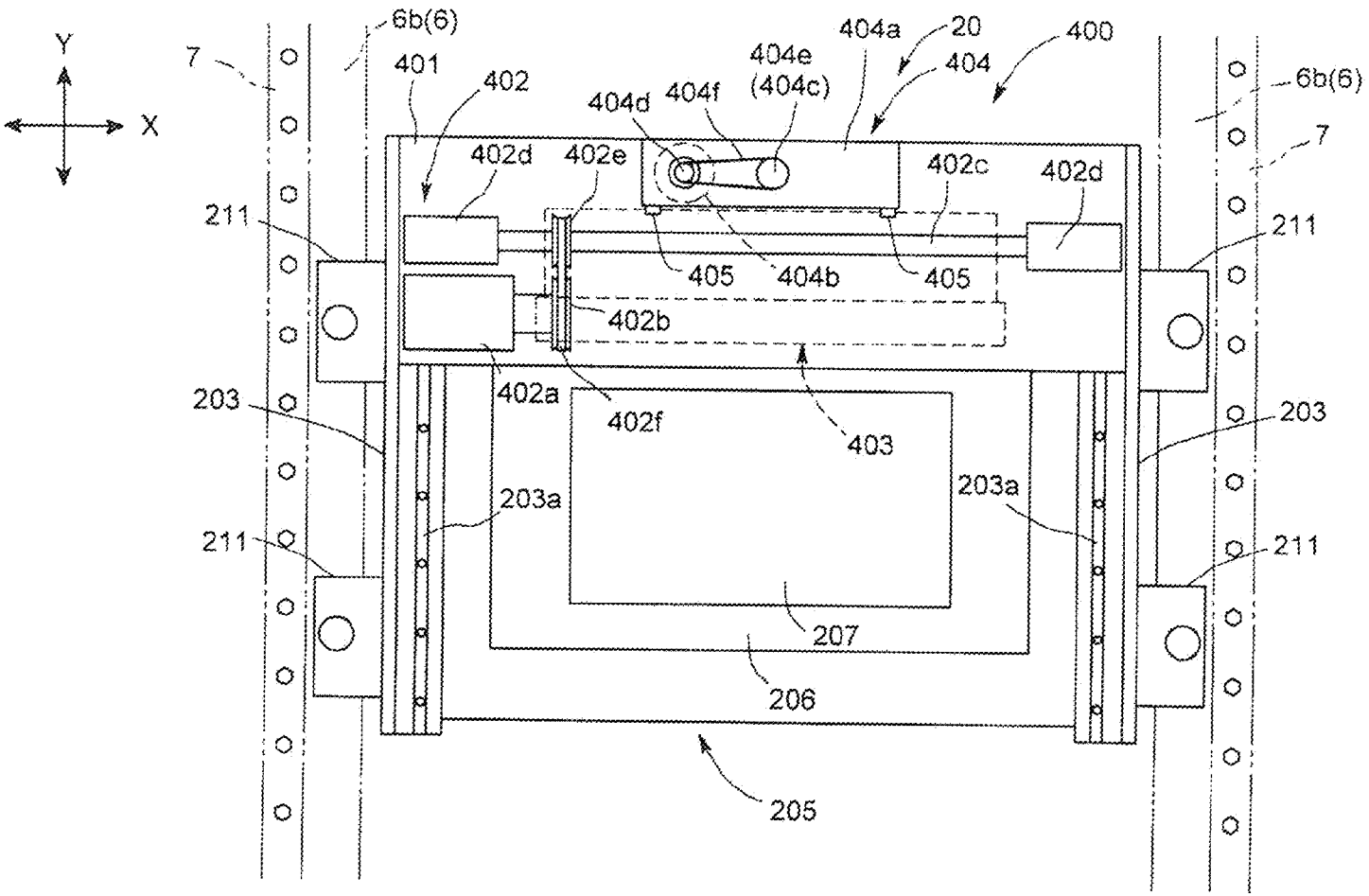
FIG. 5 a simplified enlarged plan view illustrating the printing execution unit of the screen printing apparatus shown in FIG. 1.

Referring to FIG. 5, the squeegee unit holding mechanism 400 is provided with a housing 401 extending in the X axis direction of the base 2 and connected to both fixed rails 203*a*, a squeegee reciprocating drive mechanism (Y' axis drive mechanism) 402 disposed in the upper portion of the housing 401, a squeegee unit 403 connected movably in the vertical direction to the housing 401, and a squeegee head lifting mechanism 404 that drives the squeegee unit 403 in the vertical direction.

The Y' axis drive mechanism 402 is provided with a servo motor 402*a* with an axial core arranged along the X' axis, a power transmitting shaft 402*c* that is arranged parallel to an output pulley 402*b* of the servo motor 402*a*, power transmitting units 402*d* that are provided at both ends of the power transmitting shaft 402*c* and convert the rotational force of the power transmitting shaft 402*c* into a linear force that causes the housing 401 to move along the Y' axis direction relative to the fixed rail 203*a*, a pulley 402*e* mounted on the power transmitting shaft 402*c*, and a power transmitting belt 402*f* that is stretched between the pulley 402*e* and the output pulley 402*b*, and configured such that the housing 401 can perform a reciprocating movement with a stroke range that has been set in advance relative to the mask lifting unit 203 under the effect of the rotating force of the servo motor 402*a*.

Meanwhile, the squeegee head lifting mechanism 404 is provided with a frame body 404*a* in the form of a gate-like frame that stands at the upper-end rear portion of the housing 401, a servo motor 404*b* disposed inside the frame body 404*a*, the servo motor 404*b* has an axial core extends along the Z axis direction, and a ball screw mechanism 404*c* equipped, on the side of the servo motor 404*b*, with the frame body 404*a*. An output pulley 404*d* of the servo motor 404*b* is disposed above the frame body 404*a*, and an input pulley 404*e* of the ball screw mechanism 404*c* faces the side portion of the output pulley along the X' axis. A power transmitting belt 404*f* is stretched between the pulleys 404*d*, 404*e*, and when the screw of the ball screw mechanism 404*c* is rotationally driven in either direction, a nut (not shown in the figure) that is screwed on the screw moves up or down. The nut is integrated with the squeegee unit. The vertical movement of the nut thus causes the squeegee head 403 to move up or down between the printing position at which the squeegee 41 held by the squeegee unit 403 arrives to the screen mask 206, and a retraction position that is withdrawn upward from the printing position.

Figure 6:
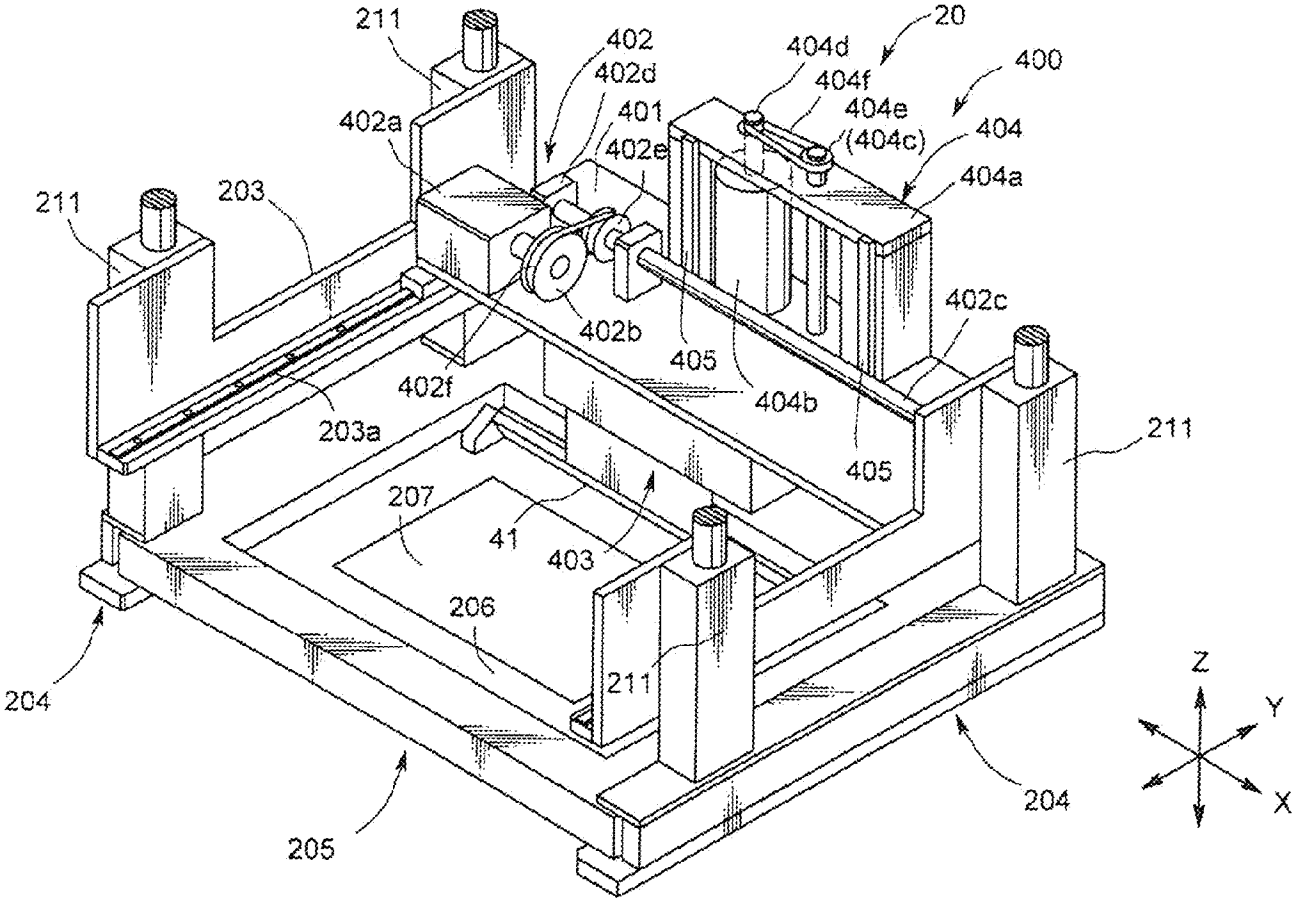
FIG. 6 is a perspective view illustrating the printing execution unit of the screen printing apparatus shown in FIG. 1.

As shown in FIG. 6, a pair of guide rails 405 extending in the vertical direction is fixed to the front portion of the frame body 404*a*, and the squeegee unit 403 is connected through the guide rails 405 to be movable along the vertical direction in a reciprocating manner.

Figure 7:
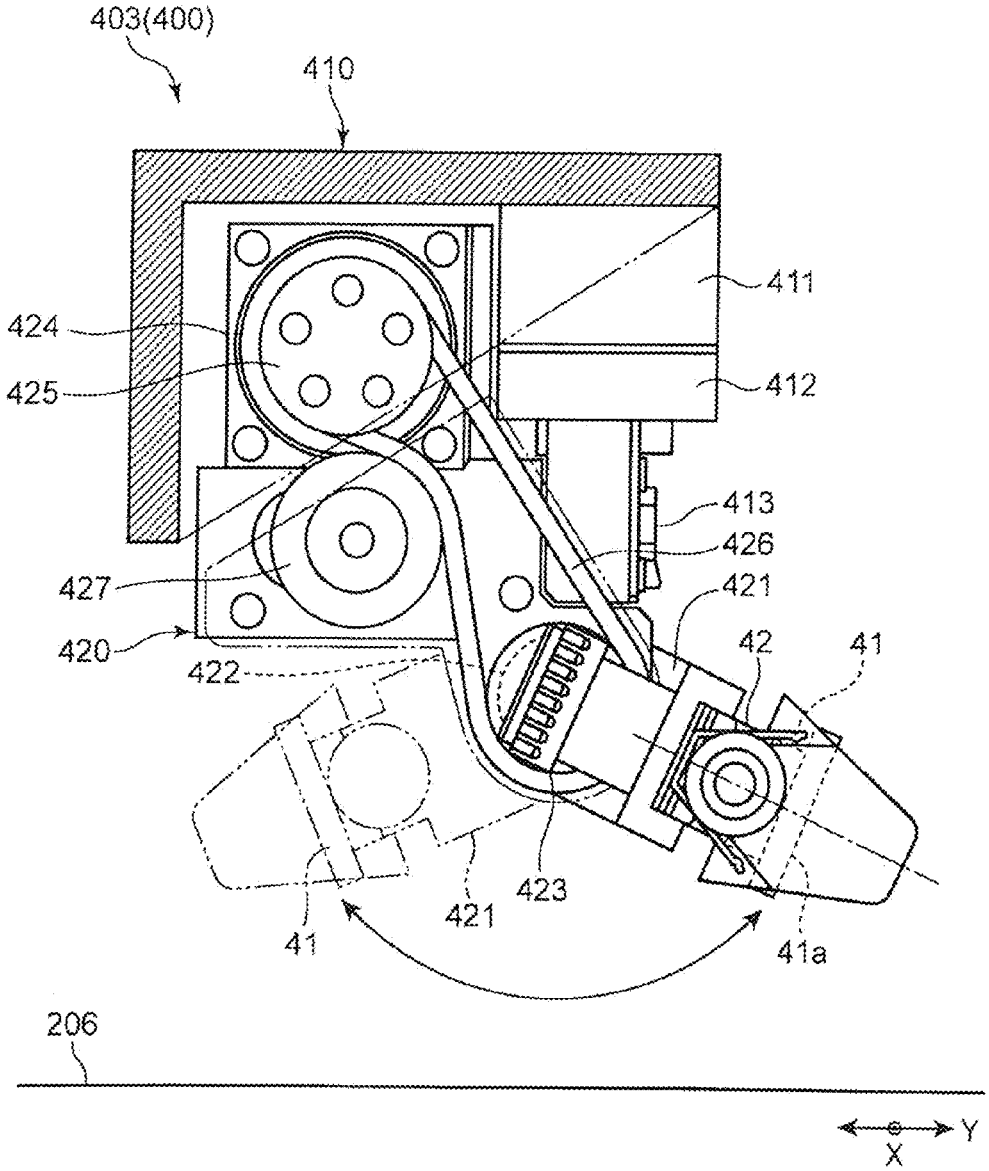
FIG. 7 is a side view illustrating a specific configuration of the head of the screen printing apparatus shown in FIG. 1.
Figure 8:
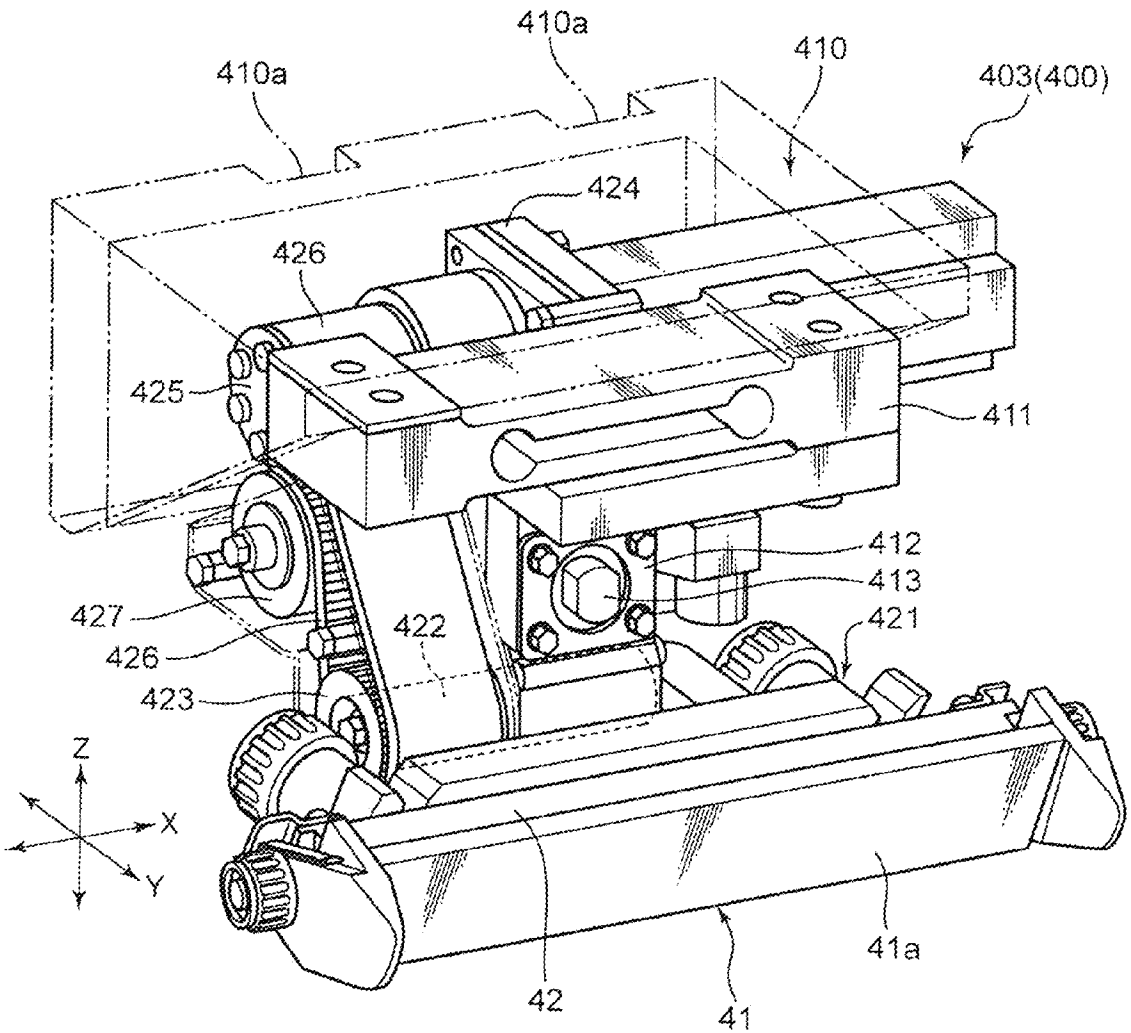
FIG. 8 is a perspective view illustrating a specific configuration of the head of the screen printing apparatus shown in FIG. 1.
Figure 9:
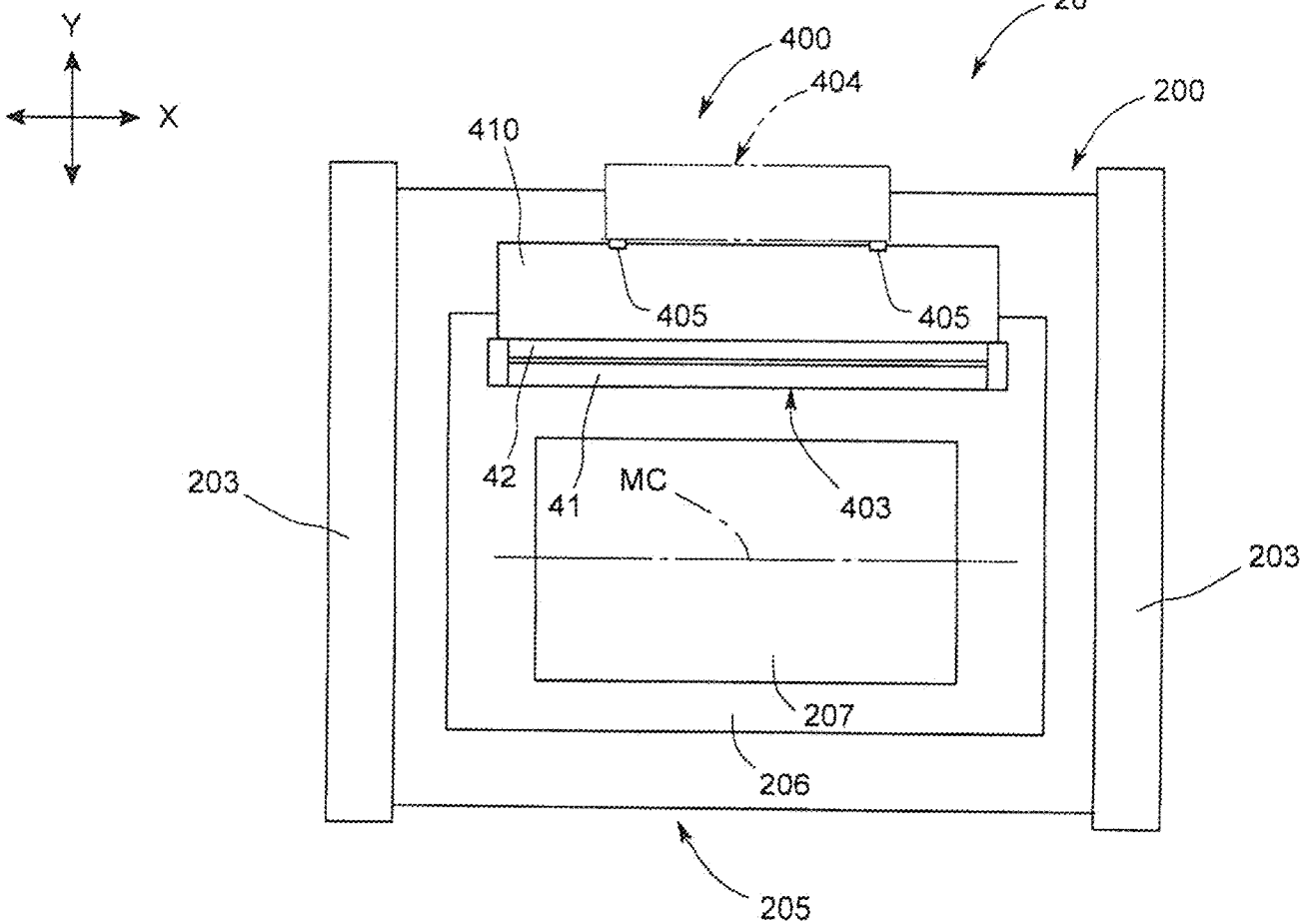
FIG. 9 is a simplified plan view illustrating the mask holding mechanism of the screen printing apparatus shown in FIG. 1.

Referring to FIGS. 7 to 9, the squeegee unit 403 has a main frame 410 and a sub-frame 420 connected to the main frame 410.

A support member 412 is disposed below a lower surface of an upper wall of the main frame 410. A pressure sensor 411 such as a load cell is disposed between the lower surface and the support member 412. A first support shaft 413 extending in the Y' axis direction is fixed to the support member 412. The sub-frame 420 is rotatably connected through a bearing to the first support shaft 413 and supported so as to be capable of oscillating about the first support shaft 413 with respect to the support member 412. In the example shown in the figure, recesses 410*a* for connection to the guide rails 405 of the frame body 404*a* are formed at the rear surface of the main frame 410.

A unit assembly 421, as a squeegee assembly, is rotatably supported by a second support shaft 422 (transverse shaft for squeegee support) at the sub-frame 420, and a squeegee rotation mechanism is assembled for driving the unit assembly 421.

The unit assembly 421 is a plane-shaped member of a rectangular shape with a long side along the X' axis direction. The squeegee 41 and a squeegee holder 42 that holds the squeegee 41 are detachably assembled at the unit assembly 421. One surface of the squeegee 41 is a working surface 41*a* for applying pressure to a paste, and the squeegee 41 is rotatably supported by the unit assembly 421 at the second support shaft 422 (transverse shaft for squeegee support) in a state in which the second support shaft 422 is positioned at the side of the opposite surface opposing to the working surface 41*a*.

The aforementioned second support shaft 422, which supports the unit assembly 421, protrudes through the sub-frame 420 to the opposite side, and the pulley 423 is mounted on and fixed to the protruding portion by a key joint. The servo motor 424 serving as a drive source is fixed to the sub-frame 420. A drive belt 426 is mounted on the aforementioned pulley 423 and the pulley 425 that is mounted on the output shaft of the servo motor 424, while a tension pulley 427 applies the tension to the drive belt 426 from the outer circumferential side thereof. In other words, the abovementioned squeegee rotation mechanism is constituted by these servo motor 424, pulleys 425, 423, 427, and drive belt 426, and when the servo motor 424 is actuated, the unit assembly 421 is rotationally driven forward or backward about the second support shaft 422. In this embodiment, a starting position of the unit assembly 421 with respect to the sub-frame 420 is detected and a reference position that will be used for rotation angle control of the sub-frame 424 is also determined. The rotations of the unit assembly 421 about the second support shaft 422 causes the squeegee 41 to change the postures: from a state in which the aforementioned working surface 41*a* is tilted to one side; to a state in which the working surface 41*a* is tilted to the other side, by the rotation of the squeeze 41 around the axis of the second support shaft 422 from a state where the working surface 41*a* is facing parallel to the screen mask 206.

The squeegee holder 42 of the squeegee unit holding mechanism 400 is a plate-like member made from a light alloy such as an aluminum alloy and extending in the X' axis direction. The squeegee 41 is a rectangular plate-shaped member made from, for example, a hard polyurethane or stainless steel and extending in the X' axis direction and is held, as shown in FIG. 8, by the squeegee holder 42 in a state of superposition on the squeegee holder 42.

The width dimension of the squeegee 41 is set such that the range in which the working surface 41*a* is in contact with the paste during the forward movement of the squeegee 41 and the range in which the working surface 41*a* is in contact with the paste during the backward movement of the squeegee 41 overlap.

Cleaning units 30A and 30B (see FIG. 10) are, respectively, assembled at appropriate locations of the first and second substrate support tables 10A and 10B to clean the screen mask 206 of the printing execution units 20A and 20B (this configuration is not shown in detail in the figures). The cleaning units 30A and 30B are provided with a cleaning head having a pad that can be in sliding contact with the lower surface of the screen mask 206 and a suction nozzle that attracts the screen mask 206 by negative pressure suction, the pad being interposed between the suction nozzle and the screen mask. When the substrate support tables 10A and 10B move in the Y axis direction, the cleaning head is brought into sliding contact with the lower surface of the corresponding screen mask 206, and the paste remaining on the lower surface of the screen mask 206 and inside the pattern holes is removed. The cleaning heads are configured to be movable in the vertical direction with respect to the substrate support tables 10A and 10B and are also configured to be disposed in a working position at which they can be in sliding contact with the screen mask 206 only during the cleaning and to be disposed at a retraction position withdrawn downward from the working position at all other times.

As shown in FIG. 2, the printing execution unit 20 is provided with the image capturing unit 50. The image capturing unit 50 performs image recognition of relative positions of the screen mask 206 and the substrate W. The image capturing unit 50 includes two mask recognition cameras 50A that pick up from below an image of a plurality of indicators such as marks or codes provided on the lower surface of the screen mask 206, and two substrate recognition cameras 50B that pick up from above an image of a plurality of indicators such as marks or codes provided on the substrates W supported on the substrate support tables 10A and 10B. The mask recognition cameras 50A are arranged at the main body 202 of the screen mask holding mechanism 200 to be movable in the X' axis direction and Y' axis direction and the substrate recognition cameras 50B are fixedly attached to the main body 202 of the screen mask holding mechanism 200. The mask recognition cameras 50A are provided to be movable two dimensionally in the horizontal direction by connection to a X'-Y' robot (not shown in the figure) and are moved below the screen mask 206, for example, during the initial setup of the screen mask 206, on the basis of the control of the X'-Y' robot performed by the below-described control unit 60 in order to pick up the images of the aforementioned indicators located on the lower surface of the screen mask 206. Meanwhile, the substrate recognition cameras 50B pick up the images of the indicators located on the substrate W when the substrate support table 10A (10B) is conveyed to the printing execution unit 20. Two indicator (fiducial mark) positions on the screen mask 206 and two indicator (fiducial mark) positions on the substrate that have been recognized by the cameras 50A, 50B are subjected to coordinate conversion from a X'-Y' coordinate system to a X-Y coordinate system located on the base 2 on the basis of a R axis direction angle obtained under an assumption of alignment in the R axis direction of the screen mask 206 with the substrate W. Then, R axis direction position alignment of the screen mask 206 and the XY position alignment of the substrate W are implemented.

Figure 10:
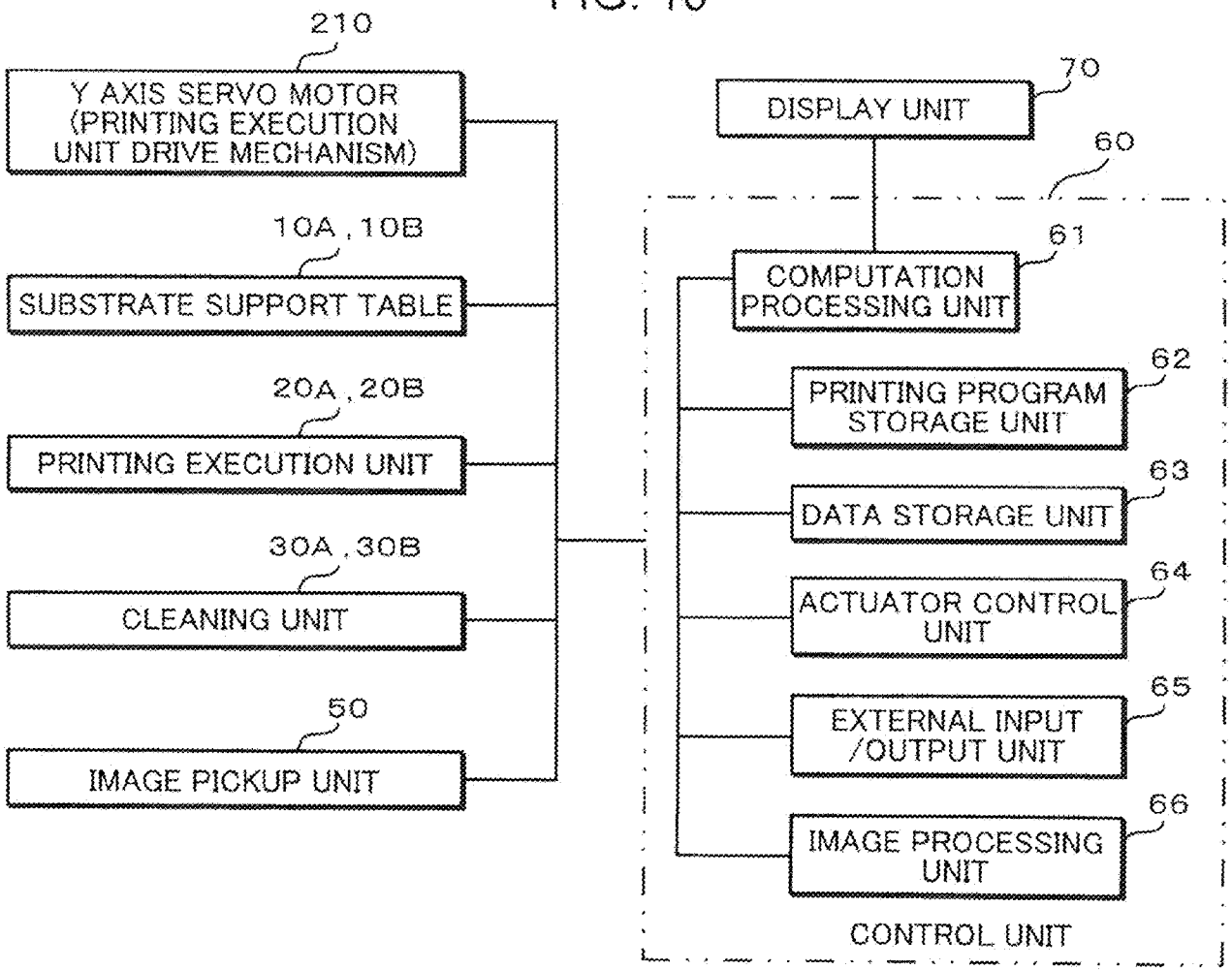
FIG. 10 is a block diagram illustrating the control configuration of the screen printing apparatus shown in FIG. 1.

As shown in FIG. 10, the control unit 60 (an example of the printing position setting section and table movement control unit in accordance with the present invention) has a computational processing unit 61 including a microprocessor or the like, a printing program storage unit 62 that stores transaction data or the like for printing processing, a data storage unit 63 that stores mask data and the like required for control, an actuator control unit 64 that drives actuators such as the aforementioned motors 5A and 5B, an external input/output unit 65 constituted by various interfaces or the like, and an image processing unit 66 constituted by a capture board or the like. The actuators and cameras such as the mask recognition cameras 50A and 50B are all electrically connected to be controllable by the control unit 60. Therefore, the control unit 60 controls generally a series of printing processing operations performed by the substrate support tables 10A and 10B and the printing execution unit 20, that is, operations of receiving the substrates W that are fed by the first and second loaders L1 and L2 in the substrate entry units En1 and Ent, screen printing on the substrates W, and carrying out the substrates W from the substrate exit units Ex1 and Ext. Further, the control unit 60 is equipped with a display unit 70 that can display the processing state by using a GUI, or any other suitable interface. An input apparatus (not shown in the figure), such as a pointing apparatus or the like, is also equipped with the control unit 60. The operator can therefore perform operations to input data for transaction or set and change the program for realizing the printing processing. The printing program storage unit 62 and the data storage unit 63 referred to herein are logical concepts to be realized by combining a ROM, a RAM, an auxiliary storage apparatus, and the like.

Figure 11:
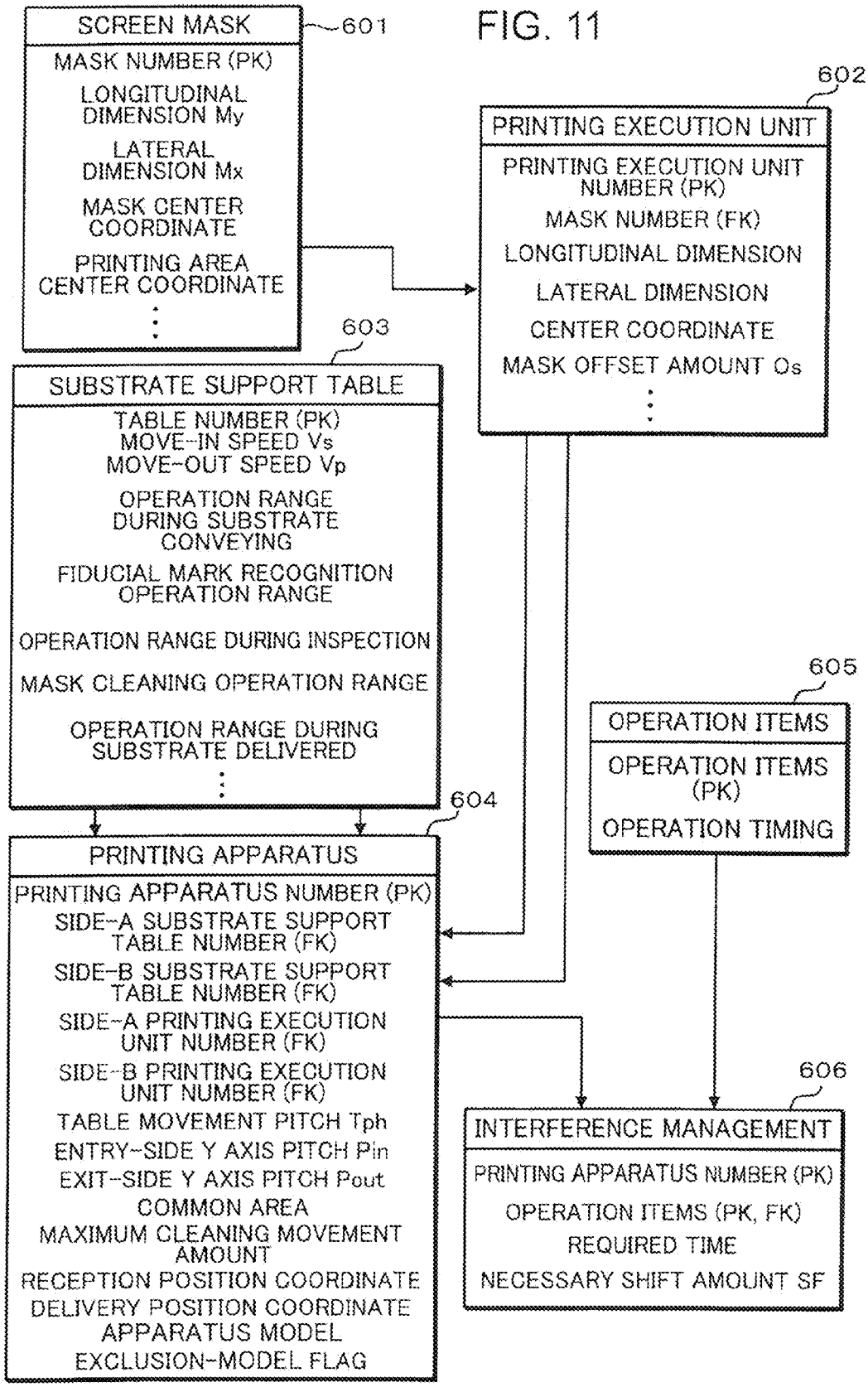
FIG. 11 is an entity relationship (ER) diagram illustrating some of the data stored in the screen printing apparatus shown in FIG. 1.

Referring to FIG. 11, the data storage unit 63 of the control unit 60 includes a screen mask data table 601 that stores data relevant to the screen mask 206, a printing execution unit data table 602 that stores data relevant to the printing execution unit 20, a substrate support table data table 603 that stores data relevant to the substrate support tables 10A and 10B, a printing apparatus data table 604 that stores data relevant to the screen printing unit 1, an operation item data table 605, and an interference management data table 606. These data tables 601 to 606 are all referred to in a database system as data sets that hold data in two-dimensional matrixes (rows and columns). In the explanation below, a field (columns) of the data tables 601 to 606 will be referred to as attributes and data (relation values stored in the set of one or more attributes) in the data tables 601 to 606 will be referred to as rows. In the figure, (PK) stands for a primary key and (FK) stands for a foreign key. The primary key is a set of attributes that uniquely identifies the row in the respective data tables 601 to 606. The foreign key is a set of attributes that matches the primary key of the data tables 601 to 606. The arrows in the figure represent the relationships between the data tables 601 to 606 and indicate that the foreign key in an entity or the data table on the end point side of the arrow refers to the primary key in the entity on the origin side of the arrow. Each of the data tables 601 to 606 is a logical entity and may be in the form of a single data file (for example, a CSV file) at a mounting time. Alternatively, each table may be a plurality of data files with consideration for normalization.

The screen mask data table 601 has MASK NUMBER as a primary key and includes other attributes such as LONGITUDINAL DIMENSION My, LATERAL DIMENSION Mx, MASK CENTER COORDINATE, and PRINTING AREA CENTER COORDINATE (see FIG. 12) or the like. By referring to the screen mask data table 601, the control unit 60 can refer the type (or model) of the screen mask 206 mounted on the screen printing apparatus 1 or the dimensional relationship thereof as a control parameter. CENTER COORDINATE of the screen mask data table 601 is for a coordinate specifying the center axes XC1, XC2 (see FIG. 12) along the X axis direction of the screen mask 206.

The printing execution unit data table 602 has PRINTING EXECUTION UNIT NUMBER as a primary key and includes other attributes such as MASK NUMBER, LONGITUDINAL DIMENSION, LATERAL DIMENSION, CENTER COORDINATE, and MASK OFFSET AMOUNT Os, or the like. MASK NUMBER is a foreign key for specifying the screen mask 206 that will be mounted on the printing execution unit 20. With this key, the screen mask data table 601 is associated with the printing execution unit data table 602. To facilitate the understanding, in the explanation below, the center coordinates Yd1, Yd2 of the printing execution units 20A and 20B (see FIG. 12) are taken to be respectively equal to the center coordinates of the screen masks 206. Further, MASK OFFSET AMOUNT OS indicates offset amounts Os1, Os2 (see FIG. 12) in the Y axis direction that occur between the associated screen mask 206 (or specific tuple) and the X axis center line of the printing execution unit 20. Where the value of MASK OFFSET AMOUNT OS are registered in advance, the control unit 60 can realize effective screen printing, as will be described herein below.

The substrate storage table data table 603 uses TABLE NUMBER as a primary key and stores attributes for units constituting the substrate support table 10A or 10B.

The printing apparatus data table 604 has PRINTING EXECUTION UNIT NUMBER as a principle key and other attributes for necessary specification to control screen printing apparatus. The printing apparatus data table 604 includes foreign keys assigned to SIDE-A SUBSTRATE SUPPORT TABLE NUMBER that associates with a unit used on the substrate support table 10A on the side A (one end side in the Y axis direction that is shown on the lower side in FIG. 1; same herein below) in the substrate support table data table 603, and SIDE-B SUBSTRATE SUPPORT TABLE NUMBER that associates with a unit used on the substrate support table 10B on the side B (another end side in the Y axis direction that is shown on the upper side in FIG. 1; same herein below) in the substrate support table data table 603. These foreign keys enable to refer the movement range of the substrate support tables 10A and 10B used in the screen printing apparatus 1 or other information such as the movement speed. The printing apparatus data table 604 has another foreign key: SIDE-A PRINTING EXECUTION UNIT NUMBER for associating with the printing execution unit 20A on the side A; and SIDE-B PRINTING EXECUTION UNIT NUMBER for association with the printing execution unit 20B on the side B that are used in the screen printing apparatus 1. Such a relationship makes it possible to refer to the specifications of the first and second printing execution units 20A and 20B used in the screen printing apparatus 1. In the example shown in the figure, the printing apparatus data table 604 has attributes including TABLE MOVEMENT PITCH Tph which stores a dimension shown in FIG. 2, ENTRY-SIDE Y AXIS PITCH Pin which stores the distance in the Y axis direction between the first and second substrate entry units En1 and Ent, EXIT-SIDE Y AXIS PITCH Pout which stores the distance in the Y axis direction between the first substrate exit unit Ex1 and the second substrate exit unit Ex2, COMMON AREA (see FIG. 1) that has been set in the screen printing apparatus 1, MAXIMUM CLEANING MOVEMENT AMOUNT during the cleaning, RECEPTION POSITION COORDINATE, and DELIVERY POSITION COORDINATE (see FIGS. 13 to 15). As a result, interference avoidances of the substrate support tables 10A and 10B and the first and second printing execution units 20A and 20B can be feasible according to the specifications of the screen printing apparatus 1. In the present embodiment, the substrate support tables 10A and 10B are supposed to be used at specifications preventing interference, but it goes without saying that a technique similar to that used with the printing execution units 20A and 20B can be used to avoid the interference of substrates. Furthermore, the printing apparatus data table 604 also includes APPARATUS MODEL that identify which model among those shown in FIGS. 13 to 15 is used in the screen printing apparatus 1 and EXCLUSION-MODEL FLAG.

APPARATUS MODEL is an attribute for changing the algorithm according to a model of the screen printing apparatus 1. There are many asymmetrical models with respect to center axis OY along the Y axis direction. The configurations shown in FIGS. 1 and 13 are such an example in which the substrate entry units En1 and En2 and the substrate exit units Ex1 and Ex2 are disposed symmetrically with respect to the X axis center axis OX of the screen printing apparatus 1, but the distance in the Y axis direction between the substrate entry units En1 and En2 (entry-side Y axis pitch Pin) is larger than the distance in the Y axis direction between the substrate exit units Ex1 and Ex2 (exit-side Y axis pitch Pout). Also the configuration shown in FIG. 14 is another example in which the entry-side Y axis pitch Pin is shorter than the exit-side Y axis pitch Pout. In the cases of these configurations, it is preferred, as will be described herein below, that the algorithm for setting the printing position be changed as appropriate.

Figure 15:
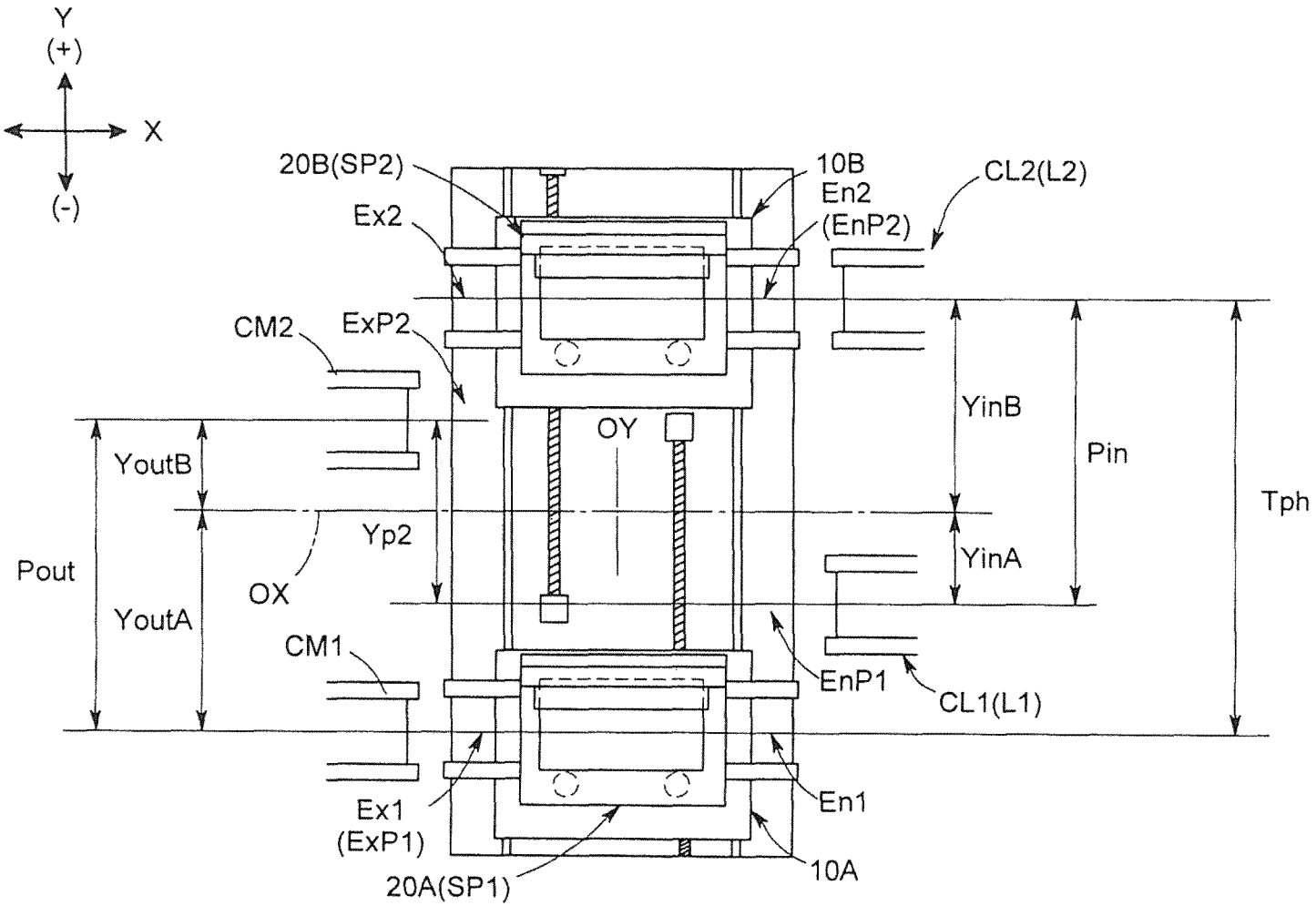
FIG. 15 is a simplified plan view illustrating yet another layout/dimensional relationship of the screen printing apparatus to which the present invention can be applied.

Meanwhile, in some cases, as shown in FIG. 15, either or both (in the example shown in the figure, both) of the combination(s) of the substrate entry positions EnP1 and EnP2 and the combination of the substrate exit positions ExP1 and ExP2 is arranged asymmetrically with respect to the X axis center axis OX of the screen printing apparatus 1. In such a case, it is preferred that yet another technique be used. In the present embodiment, the below-described subroutine can be changed according to the arrangement mode of the screen printing apparatus 1 by including APPARATUS MODEL into the printing apparatus data table 604.

Figure 13:
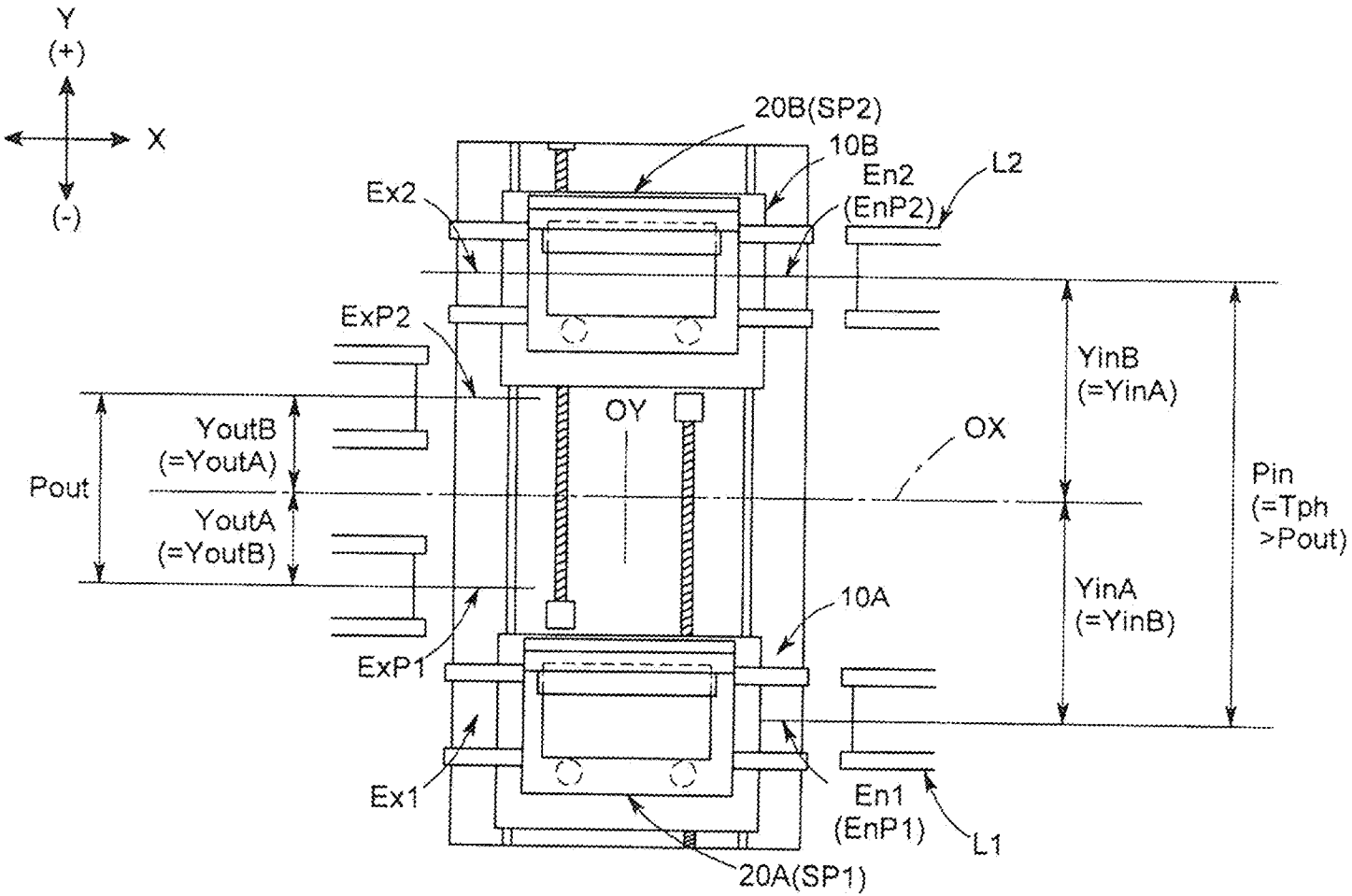
FIG. 13 is a simplified plan view illustrating the dimensional relationship of the screen printing apparatus shown in FIG. 1.
Figure 14:
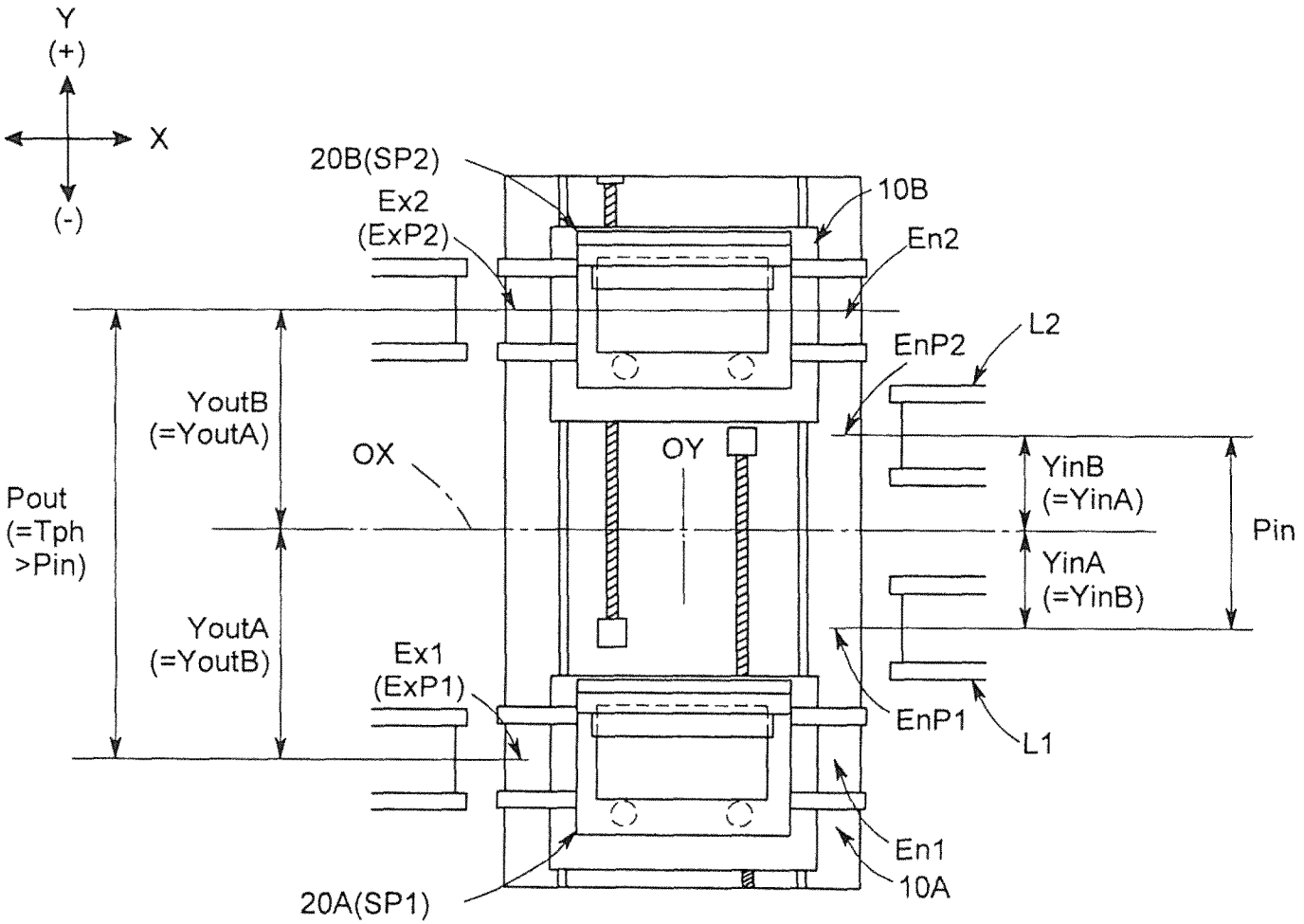
FIG. 14 is a simplified plan view illustrating another layout/dimensional relationship of the screen printing apparatus to which the present invention can be applied.

EXCLUSION-MODEL FLAG of the printing apparatus data table 604 is used for determining whether the screen printing apparatus 1 with the specifications shown by way of example in FIGS. 13 to 15 is of a model which exclusively does not accept the first and second printing execution units 20A and 20B to move into the common area simultaneously. EXCLUSION-MODEL FLAG stores preset values that are set when the combination of components of the screen printing apparatus 1 is determined and the substrate entry positions EnP1 and EnP2 and the substrate exit positions ExP1 and ExP2 are set. For example, with the models shown in FIGS. 13 and 14, the first substrate entry position EnP1 and the first substrate exit position ExP1 are, respectively, symmetrical to the second substrate entry position EnP2 and the second substrate exit position ExP2 with respect to the center axis OX in the X axis direction of the screen printing apparatus 1. Therefore, by leaving a predetermined distance in the Y axis direction (this distance is referred to as retraction distance RL) between these two units, it is possible to ensure that portions thereof will move into the common area, without interference. Meanwhile, with the model shown in FIG. 15, where one printing execution unit occupies the common area as the printing position, the other printing execution unit can be prevented from conveying the substrate or delivering. Accordingly, in the present embodiment, EXCLUSION-MODEL FLAG is used to identify whether the model is exclusive for each screen printing apparatus 1. EXCLUSION-MODEL FLAG is, for example, of a Boolean type, and when the value is TRUE, it denotes that the screen printing apparatus 1 is of an exclusive-model. Where EXCLUSION-MODEL FLAG is set, the determination processing can be expedited because it is not necessary to refer to other parameters or perform computations so that the interference avoidance is distinguished. If, however, there are no obstacles for the calculations, EXCLUSION-MODEL FLAG may be omitted and the presence or absence of interference may be dynamically computed (derived) on the basis of the substrate entry positions EnP1 and EnP2 and/or the substrate exit positions ExP1 and ExP2.

Further, the operation item data table 605 serves to store the operations of the substrate support tables 10A and 10B that should be checked by the control unit 60 for realizing the screen printing process, and stores OPERATION ITEMS as a primary key and OPERATION TIMING. Example instances of the OPERATION ITEMS include "substrate conveying operation", "fiducial mark recognition operation", "after-printing inspection operation", "mask cleaning operation", and "substrate delivery operation", and example instances of OPERATION TIMING include "before the printing" and "after the printing".

The interference management data table 606 is a link entity (serves for many-to-many relationship) assigning a primary key to {PRINTING APPARATUS NUMBER, OPERATION ITEMS}. For each screen printing apparatus 1, the interference management data table 606 set OPERATION ITEMS for the required interference management, REQUIRED TIME, and MOVEMENT AMOUNT (necessary shift amount) SF for interference avoidance. Since REQUIRED TIME is set in the interference management data table 606, the control unit 60 can predict the time zone in which the move-in operation can be accepted on the basis of REQUIRED TIME, or can predict the time zone in which one printing execution unit can move into the common area of the printing execution units 20A (20B) during the concurrent operation of the pair of printing execution units 20A (20B).

In the present embodiment, as shown in FIG. 11, since the operation item data table 605 and the interference management data table 606 are provided, data such as shown in Table 1 below can be stored and used as control parameters.

TABLE 1

| Operation item | FIG. 13 | FIG. 14 | FIG. 15 | Operation timing | Predetermined time (sec) |
|---|---|---|---|---|---|
| Substrate conveyed operation | 0 | 300 | 500 | Before printing | 7 |
| Mark recognition (pre-process) | 0 | 300 | 500 | Before printing | 6 |
| Inspection after printing (after-process) | 300 | 300 | 300 | After printing | 6 |
| Cleaning (after-process) | 200 | 200 | 200 | After printing | 12 |
| Substrate delivery operation | 300 | 0 | 800 | After printing | 7 |

Table 1 represents instances of NECESSARY SHIFT AMOUNT SF for each operation item for which the interference avoidance is necessary in the apparatuses corresponding to FIGS. 13 to 15. NECESSARY SHIFT AMOUNT SF stores an absolute value of the length (in the Y axis direction) of penetration into the common area that is performed to execute the operation.

The printing process performed in the screen printing apparatus 1 under control by the control unit 60 will be explained below.

Figure 16:
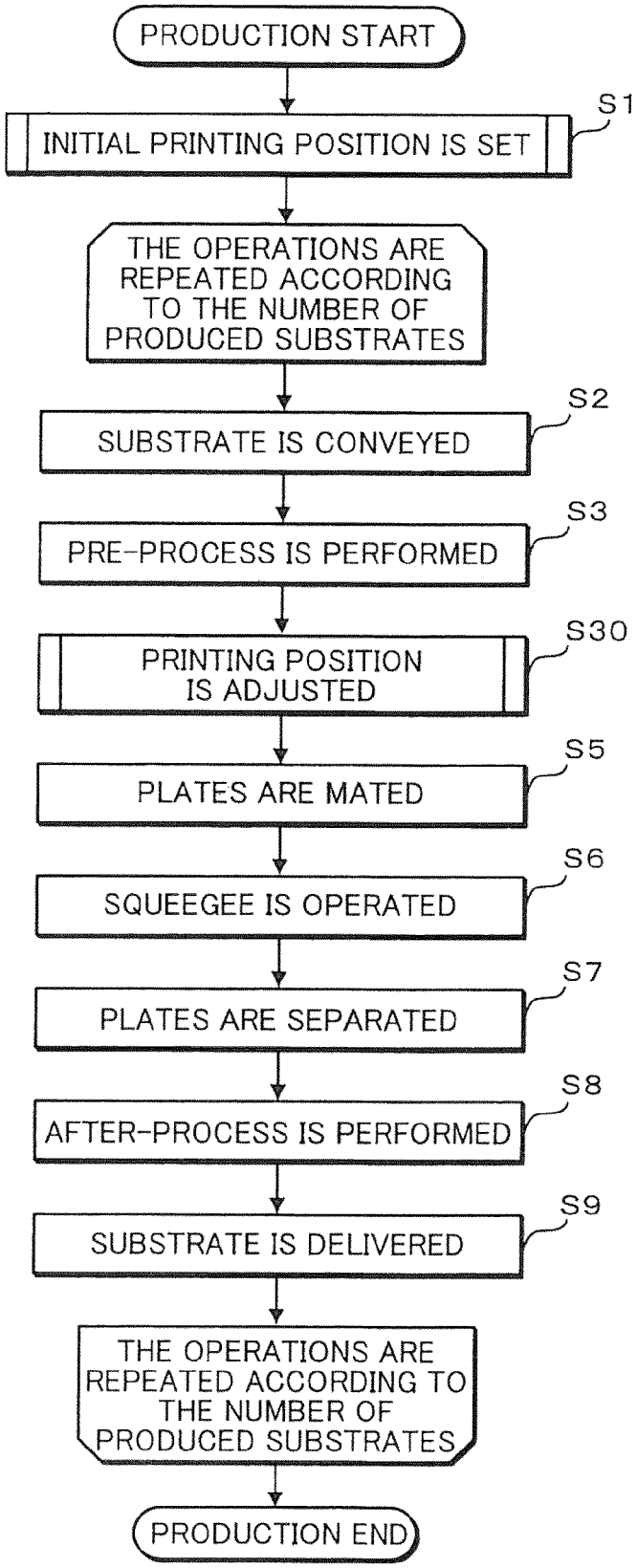
FIG. 16 is a flowchart illustrating the production flow relating to the first embodiment of the present invention.

Referring to FIG. 16, the control unit 60 initially executes an initial printing position setting subroutine (step S1) and sets printing positions SP1, SP2 that are advantageous for starting the screen printing on the substrates W on the substrate support tables 10A and 10B. Then, the control unit 60 operates the first substrate support table 10A in parallel with the second substrate support table 10B and repeatedly (according to the number of substrates to be processed) executes the substrate conveying operation (step S2), pre-process (step S3), printing position adjustment processing subroutine (step S30), plate mating (X direction position alignment of the substrate W by X direction position alignment of the X table 141, Y axis position alignment of the substrate W by the motors 5A and 5B of the substrate support tables 10A and 10B, and R axis direction position adjustment of the screen mask 206 by R axis direction position adjustment of the main body of the screen mask holding mechanism by the rotation drive mechanism of the screen mask holding mechanism) (step S5), squeegee operation for cream solder (step S6), plate separation (step S7), after-process including the operation of leaving the substrate support tables 10A and 10B from the printing positions SP1, SP2 (step S8), and delivery operation of carrying the substrate W subjected to printing after the departure (step S9). Among these steps, the pre-process (step S3) includes, for example, a "mark recognition" process of recognizing the indicators on the substrate W, a "bad mark recognition" process of recognizing a defect mark that has been set on any of multi-piece substrates W that are separated after component mounting, and a "foreign matter inspection" process of inspecting foreign matter that has adhered to the substrate W. The after-process (step S8) includes, for example, a "cleaning processing" process of cleaning the superposition surface of the screen mask 206 after the printing process or an "after-printing inspection" process of inspecting the printing state on the substrate W after the printing.

The initial printing position setting subroutine S1 illustrated by FIG. 16 will be explained below with reference to FIGS. 17 and 18. In this case, the initial printing position setting subroutine S1 can be implemented, for example, in two modes, namely, the mode shown in FIG. 17 and the mode shown in FIG. 18.

First, the mode shown in FIG. 17 will be explained. From the substrate support table data table 603 and the printing apparatus data table 604, the control unit 60 refers to the coordinate of the corresponding reception position (step S101). Then, it is determined on the basis of the values set in the printing apparatus data table 604 as to whether or not the coordinate is within the common area (step S102). Where the coordinate is in the common area, the control unit 60 further refers to EXCLUSION-MODEL FLAG of the printing apparatus data table 604 (step S103) and determines whether or not the value of EXCLUSION-MODEL FLAG is TRUE (step S104).

Where the value of EXCLUSION-MODEL FLAG is TRUE, the printing position SP1 (SP2) cannot be set to the common area. Therefore, the control unit 60 retracts the printing execution unit in the direction of withdrawal from the other printing execution unit 20B (20A). Then, the control unit 60 sets the printing position outside the common area, yet on the substrate conveying paths PH1, PH2, and returns to the main routine (step S105). Where the value of EXCLUSION-MODEL FLAG is FALSE, the control unit 60 calculates the retraction distance RL on the basis of the following equation (1) (step S106):

$$\text{Retraction distance } RL = \left|\left(\frac{My1}{2} + SF\right) - \left(\frac{My2}{2} + SF\right)\right| - \frac{|Y1 - Y2|}{2} \quad (1)$$

Figure 12:
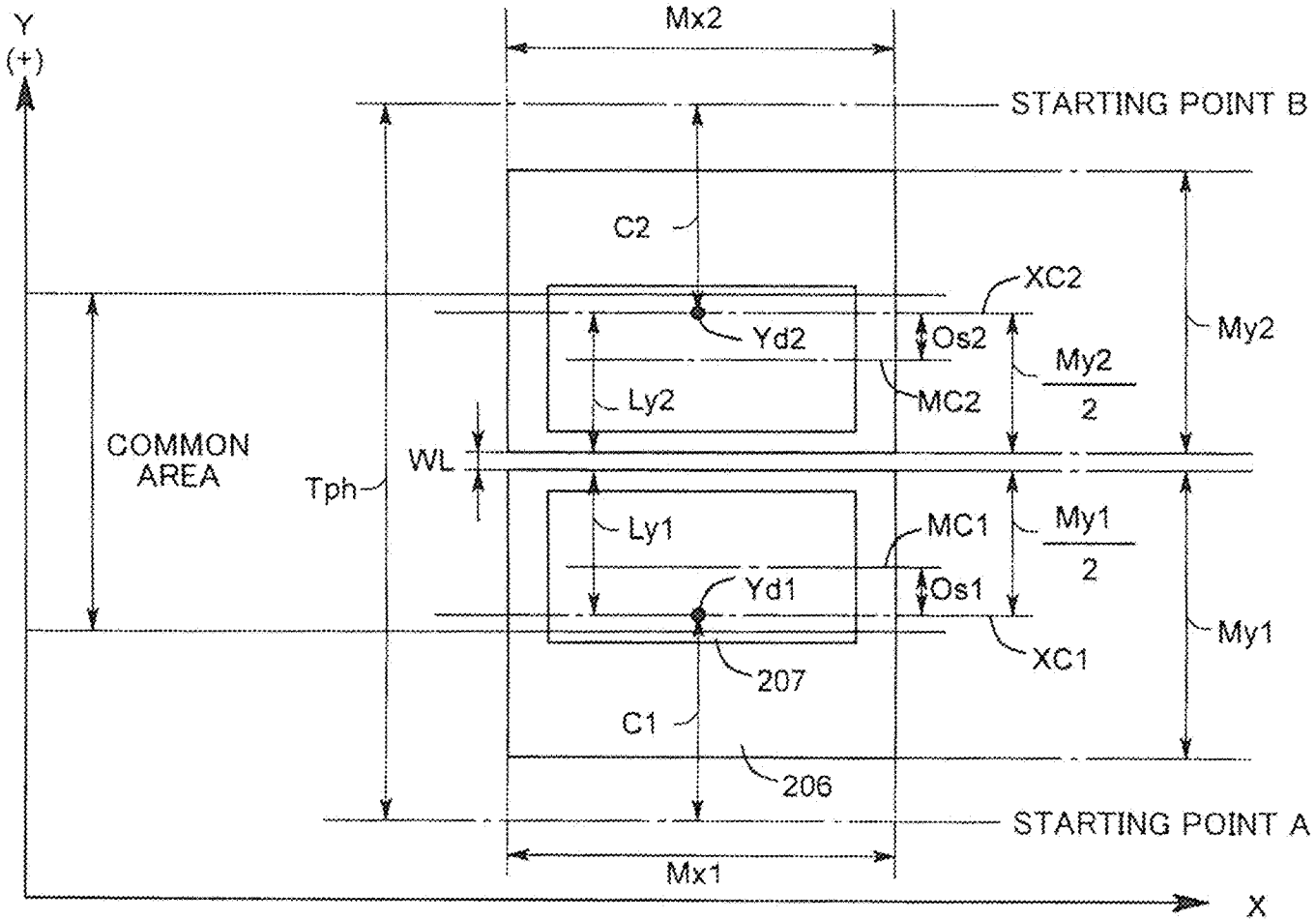
FIG. 12 is a simplified plan view illustrating the dimensional relationship of the screen mask relating to FIG. 1.

As clearly follows from FIG. 12, the retraction distance RL in equation (1) is obtained by dividing into two equal halves a predetermined opposing distance WL at which the two printing execution units 20A and 20B do not interfere. As a result, both printing execution units 20A and 20B can execute the printing process in the equally retracted positions. In this case, the opposing distance WL is defined by the following equation (2):

$$\text{Opposing distance } WL = Tph - (C1 + C2) - |Ly1 + Ly2| \quad (2)$$

In equation (2), C1 stands for a distance traveled by the substrate support table 10A on the side A from an origin on the side A in the Y axis direction in the table movement pitch Tph, C2 stands for a distance traveled by the substrate support table 10B on the side B from an origin on the side B in the Y axis direction, Ly1 stands for a distance from the center (center Yd1 of the printing execution unit 20A) of the substrate support table 10A on the side A to the opposing portion on the substrate support table 10B on the side B, and Ly2 stands for a distance from the center (center Yd2 of the printing execution unit 20B) of the substrate support table 10B on the side B to the opposing portion on the substrate support table 10A on the side A.

In order to distinguish between the sides A and B in FIG. 12, additional notations other than the abovementioned distances C1, C2, Ly1, and Ly2 are designated as follows: the dimensions of the screen mask 206 in the X axis direction are designated by Mx1 and Mx2, dimensions in the Y axis direction are designated by My1 and My2, center axes in the X axis direction are designated by XC1 and XC2, and center axes of the printing area 207 in the X axis direction are designated by MC1 and MC2.

The value of the reception position that has been initially referred to is then corrected on the basis of the retraction distance RL, and the resultant position is set as an initial printing position (step S107). With such processing, a transition to the printing process with the substrate support table 10A (10B) can be immediately made at the timing in which the conveying process of the substrate W has been completed, and the loss by undesirable detour can be reduced as much as possible.

When the substrate entry position is determined in step S102 not to be in the common area, the control unit 60 immediately sets the reception position to the substrate entry position EnP1 (EnP2) (step S108).

Figure 17:
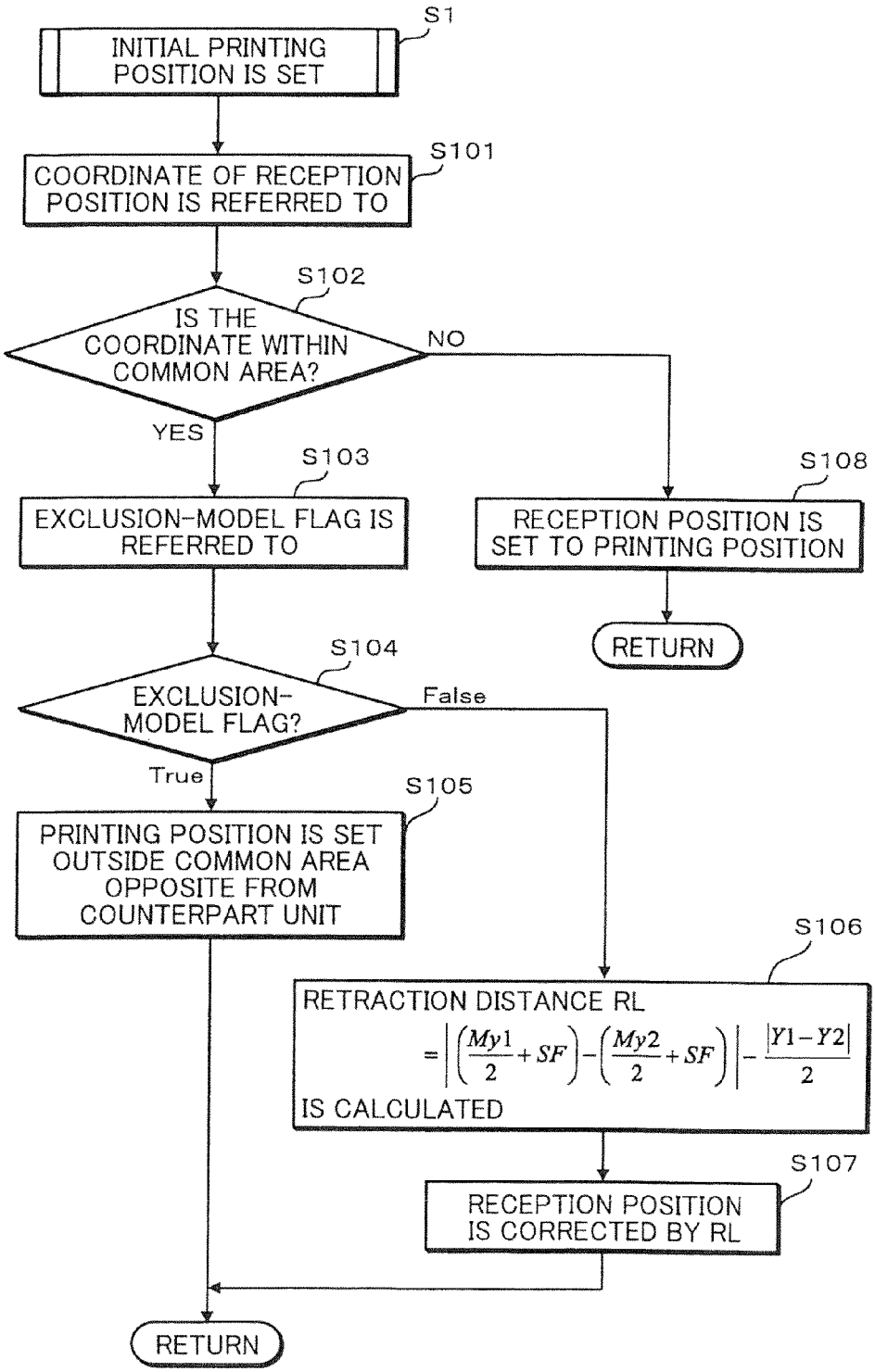
FIG. 17 is a flowchart illustrating an initial printing position setting subroutine in FIG. 16.
Figure 18:
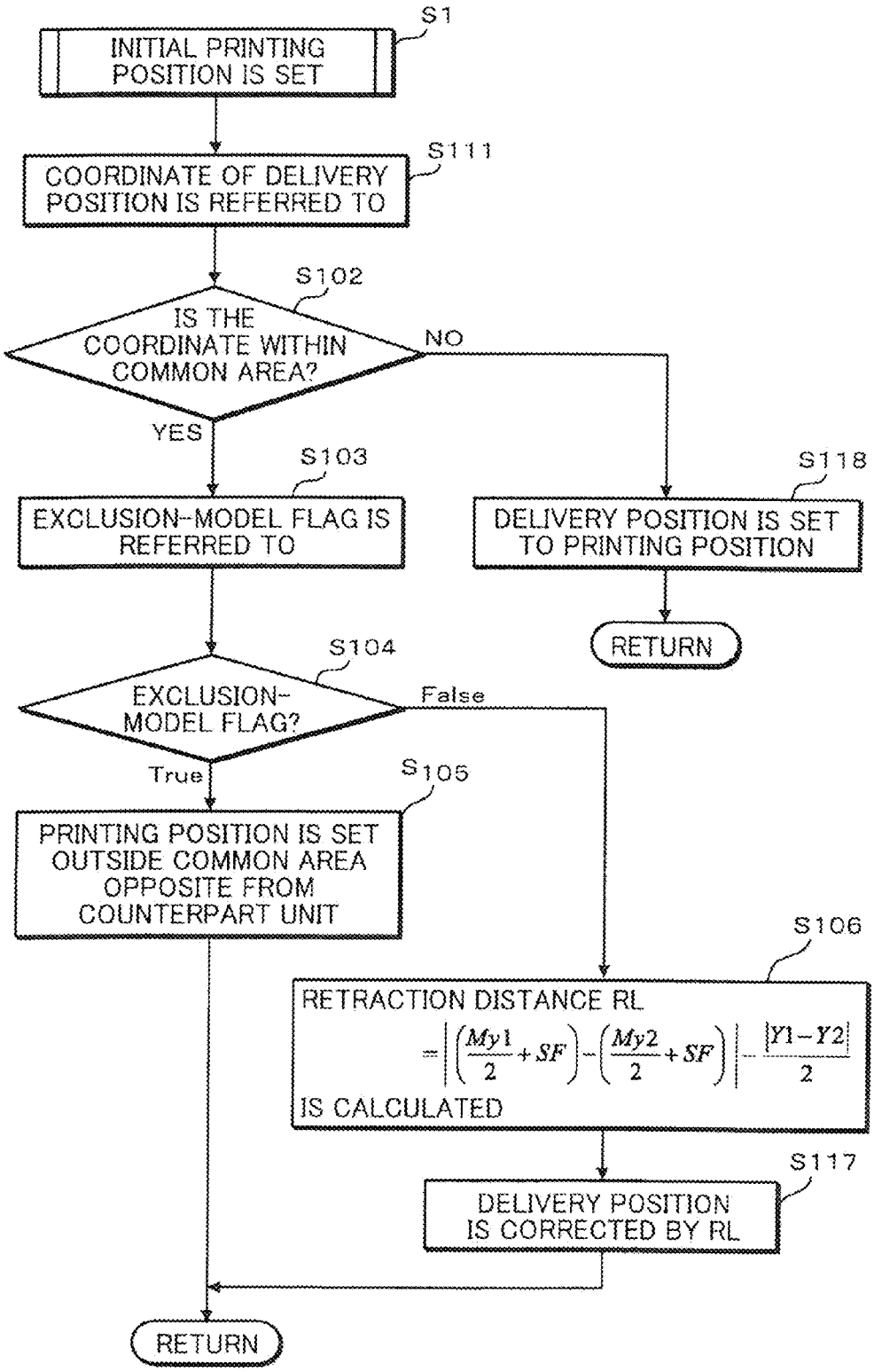
FIG. 18 is a flowchart illustrating another initial printing position setting subroutine in FIG. 16.

The mode shown in FIG. 18 differs from the mode shown in FIG. 17 in that step S101 is replaced with step S111, and steps S107 and S108 are replaced with steps S117 and S118, respectively.

That is, the mode shown in FIG. 18 differs from FIG. 17 in that, instead of the reception position, the coordinate of the delivery position is referred to in step S111, and the printing position is set according to the coordinate of the delivery position referred to, or the coordinate of the delivery position corrected. Where a program of these modes such as shown by way of example in FIGS. 17 and 18 is installed in the control unit 60, the control unit 60 can set the printing position SP1 (SP2) to the substrate entry position EnP1 (EnP2) or the substrate exit position ExP1 (ExP2).

Based upon the attribute {APPARATUS MODEL} of the printing apparatus data table 604, one of the aforementioned modes has been set in the control unit 60, in advance. For example, in the case of the screen printing apparatus 1 of the mode (model) shown in FIG. 13, the mode shown in FIG. 17 will be selected. Also in the case of the screen printing apparatus 1 of the mode (model) shown in FIG. 14, the mode shown in FIG. 18 will be selected. Further, in the case of the screen printing apparatus 1 of the mode (model) shown in FIG. 15, either one of flowcharts shown in FIGS. 17 *and* 18 will be set. As a result, it is possible to set the printing position SP1 (SP2) on the substrate conveying path PH1 (PH2) and so that none of the printing execution apparatuses 20A and 20B interferes with the other printing execution apparatus.

Next, the printing position adjustment processing subroutine S30 shown in FIG. 16 will be explained below with reference to FIG. 19.

The subroutine is executed after the pre-process of step S3 has been implemented, as shown in FIG. 16. In the pre-process, the substrate support table 10A (10B) that supports the substrate W moves in the Y axis direction in order to capture the image of the position of the identification object (which is a general concept including a fiducial mark, a bad mark, and foreign matter) on the substrate W, as mentioned hereinabove. The two substrate recognition cameras 50B of the image capturing unit 50 which is in a relative motion relationship with the substrate support table 10A (10B) capture the images of the corresponding identification objects, and the substrate support table 10A (10B) is stopped at a timing in which the very last identification object is image-captured.

Figure 19:
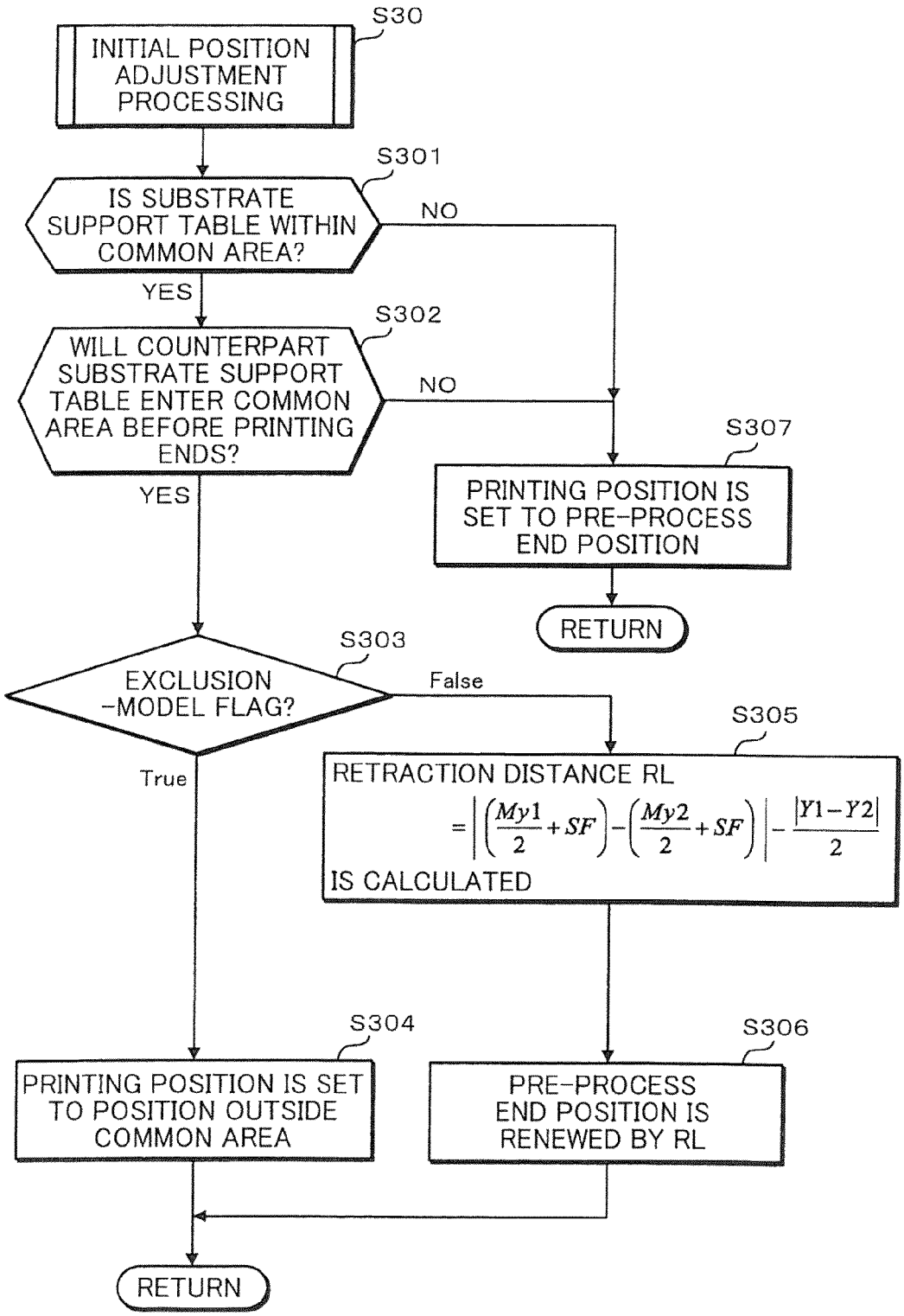
FIG. 19 is a flowchart illustrating a printing position adjusting processing subroutine in FIG. 16.

Referring to FIG. 19, the control unit 60, in this state, first determines as to whether the stopped substrate support table 10A (10B) is within the common area (step S301), on the basis of information of the encoder of the motor 5A (5B), or the like.

Where the substrate support table is within the common area, the control unit 60 then refers to the value of REQUIRED TIME of the interference management data table 606 and determines whether the other substrate support table 10B (10A) would enter the common area before the substrate support table 10A (10B) terminate the printing, that is, whether or not interference would occur during the printing (step S302).

When it is determined that interference would occur during the printing, the control unit 60 refers to the exclusion-type flat of the printing apparatus data table 604 and determines whether or not the value of EXCLUSION-MODEL FLAG is TRUE (step S303).

Where the value of EXCLUSION-MODEL FLAG is TRUE, the control unit 60 retracts the substrate support table in the direction departing from the other substrate support table 20B (20A), sets the printing position outside the common area and returns to the main routine (step S304). Where the value of EXCLUSION-MODEL FLAG is FALSE, the control unit 60 calculates the retraction distance RL on the basis of equation (1) (step S305). Then, the control unit 60 renews the stop position coordinate of the stopped substrate support table 10A (10B) on the basis of the retraction distance RL and sets the renewed coordinate as the printing position coordinate (step S306). As a result of this processing, the substrate support table 10A (10B) can be transferred to the printing process by moving from the position at which the pre-process has been completed through a very small distance, which makes it possible to avoid interference, and loss for undesirable routes can be also avoided as much as possible.

Meanwhile, when the stop position of the substrate support table is determined in step S301 to be outside the common area, or when the interference is determined in step S302 to be absent, the control unit 60 sustains the pre-process end position as the printing position (step S307). As a result, the transition to the printing process with the substrate support table 10A (10B) can be immediately made at a position where the pre-process has ended, and the loss caused by undesirable routes can be avoided as much as possible.

Figure 20:
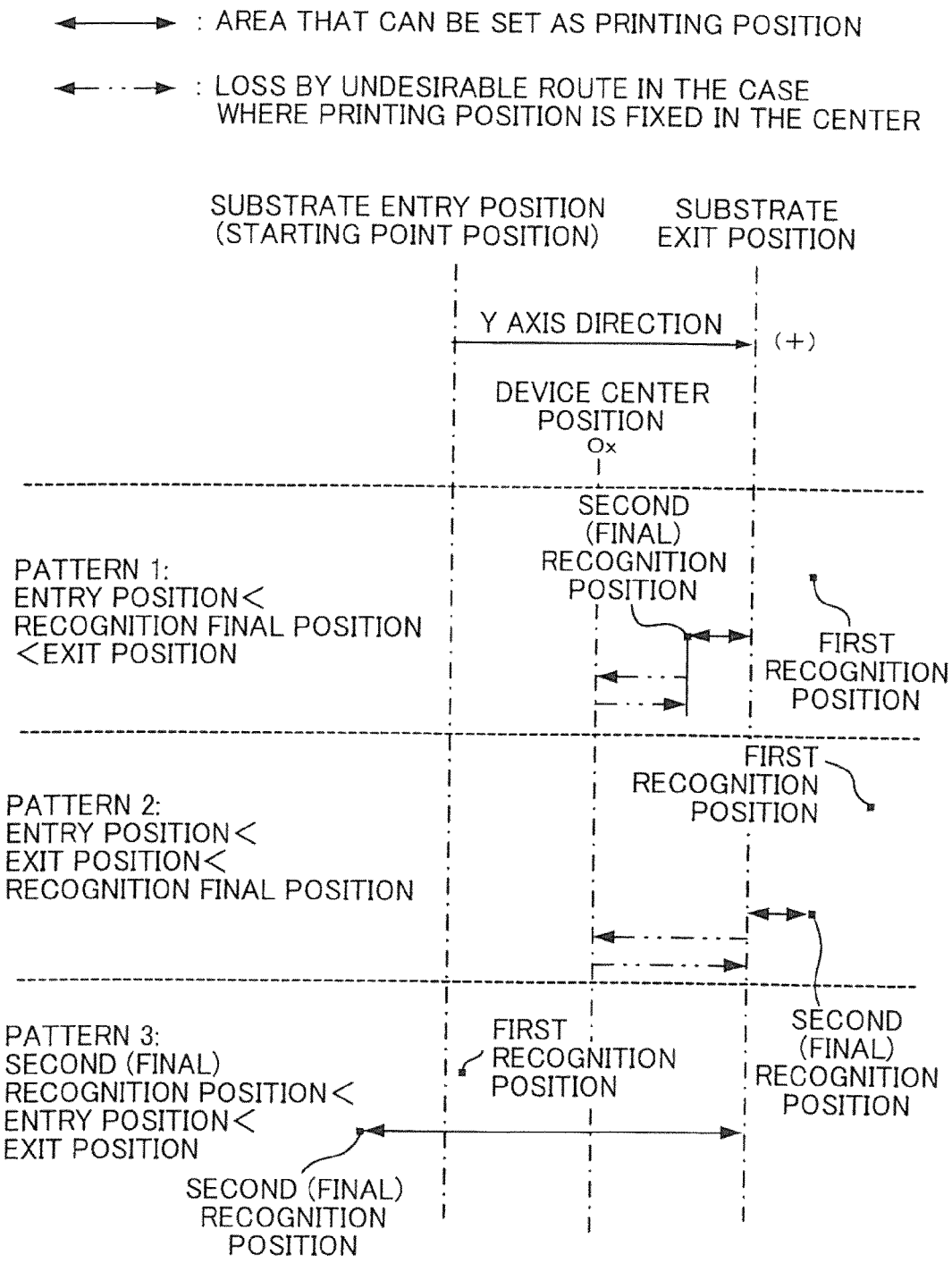
FIG. 20 is an explanatory drawing illustrating the movement range of the substrate support table based on the results obtained in executing the subroutine shown in FIG. 19.

Referring to FIG. 20, the position at which the substrate support table 10A (10B) stops in the pre-process can be realized in various forms, as shown by way of example by patterns 1 to 3. In any case, however, the setting of the printing position is determined, according to the final position at which the pre-process has terminated, by setting the printing position SP1 (SP2) on the basis of the flow shown in FIG. 19. As a result, the substrate support table 10A (10B) can move on to the printing process avoiding loss caused by the undesirable detour, as shown by virtual lines starting from the position at which is stopped temporality, which would be necessary in case the printing position is fixed at the center. Therefore, in the present embodiment, the transition to the printing process that follows the pre-process can be made smoothly and within a very short time interval. In addition, concurrent operations can be realized, while avoiding interference. As shown by solid arrows in FIG. 20, the printing position SP1 (SP2) can be set at any positions, provided that the printing position SP1 (SP2) is located between the stopping position of the substrate support tables 10A and 10B at the time the pre-process is ended and the substrate exit positions ExP1 and ExP2. For example, when the substrate support tables 10A and 10B and the printing execution units 20A and 20B are shifted relative to each other after the printing process and the cleaning processing is implemented, the printing position may be set to the starting position of the cleaning processing. As a result, the printing position can be set in various zones within a range in which the conveying path of the substrate W does not turn back.

Figure 21:
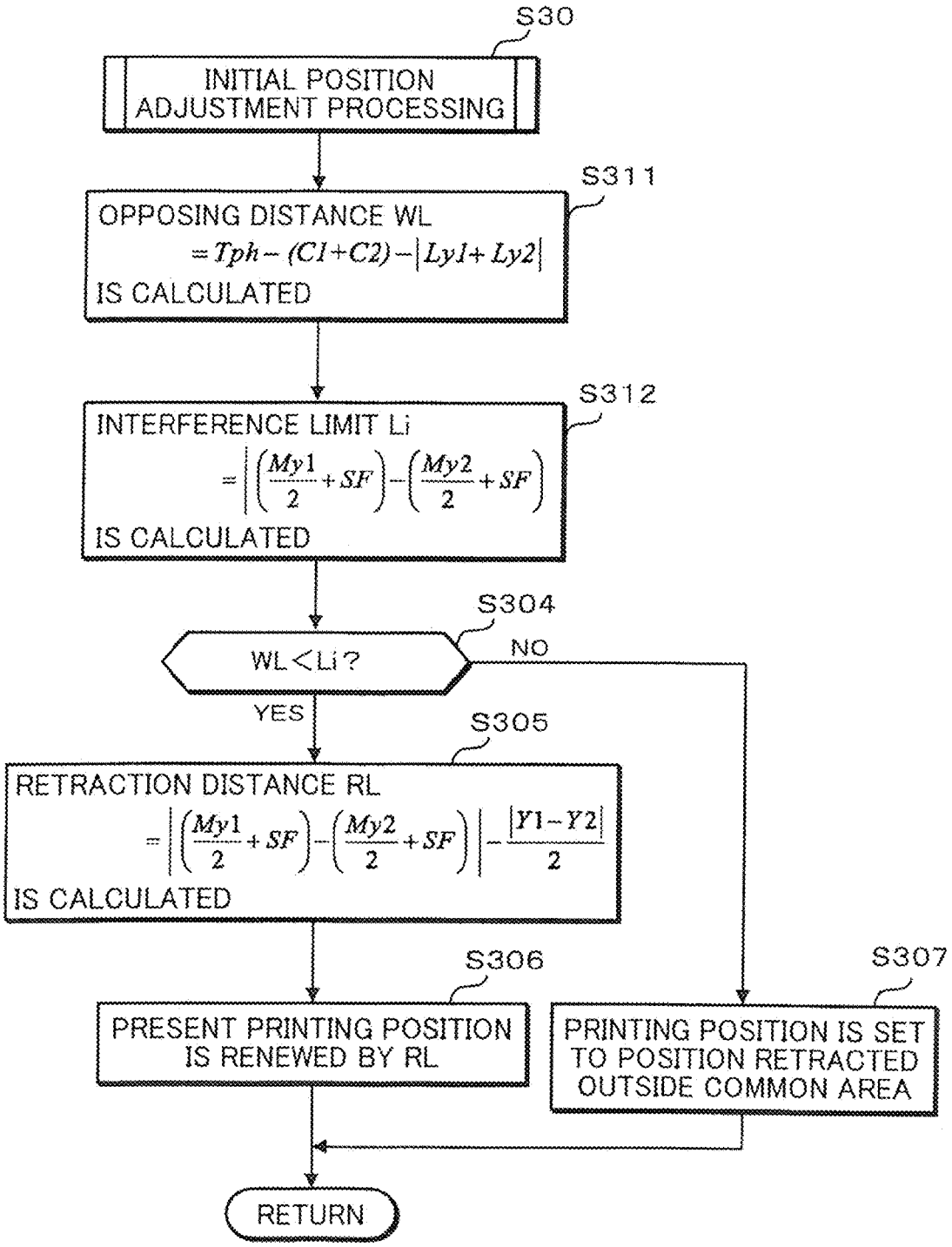
FIG. 21 is a flowchart illustrating another printing position adjusting processing subroutine in FIG. 16.

The printing position adjustment processing subroutine S30 shown in FIG. 21 can be also realized if the printing processes are executed synchronously in the screen printing apparatus 1 of models shown in FIG. 13 or 14.

Referring to FIG. 21, in the mode shown in this figure, the opposing distance WL (see FIG. 12) to the other substrate support table is calculated (step S311) and then an interference limit Li is calculated by equation (3) (step S312), instead of performing the steps S301 and S302 shown in FIG. 19.

$$\text{Interference limit } Li = \left|\left(\frac{My1}{2} + SF\right) - \left(\frac{My2}{2} + SF\right)\right| \quad (3)$$

The interference limit Li referred to herein is the shortest distance to which the two substrate support tables 10A and 10B can approach each other without interference. Then, the opposing distance WL and the interference limit Li are compared (step S313), and when the opposing distance WL is less than the interference limit Li, steps S305 and S306 are executed. This flow also enables immediate transition to the printing process at the position where the process has ended, while avoiding interference, and the loss caused by the undesirable routes can be avoided as much as possible.

Figure 22:
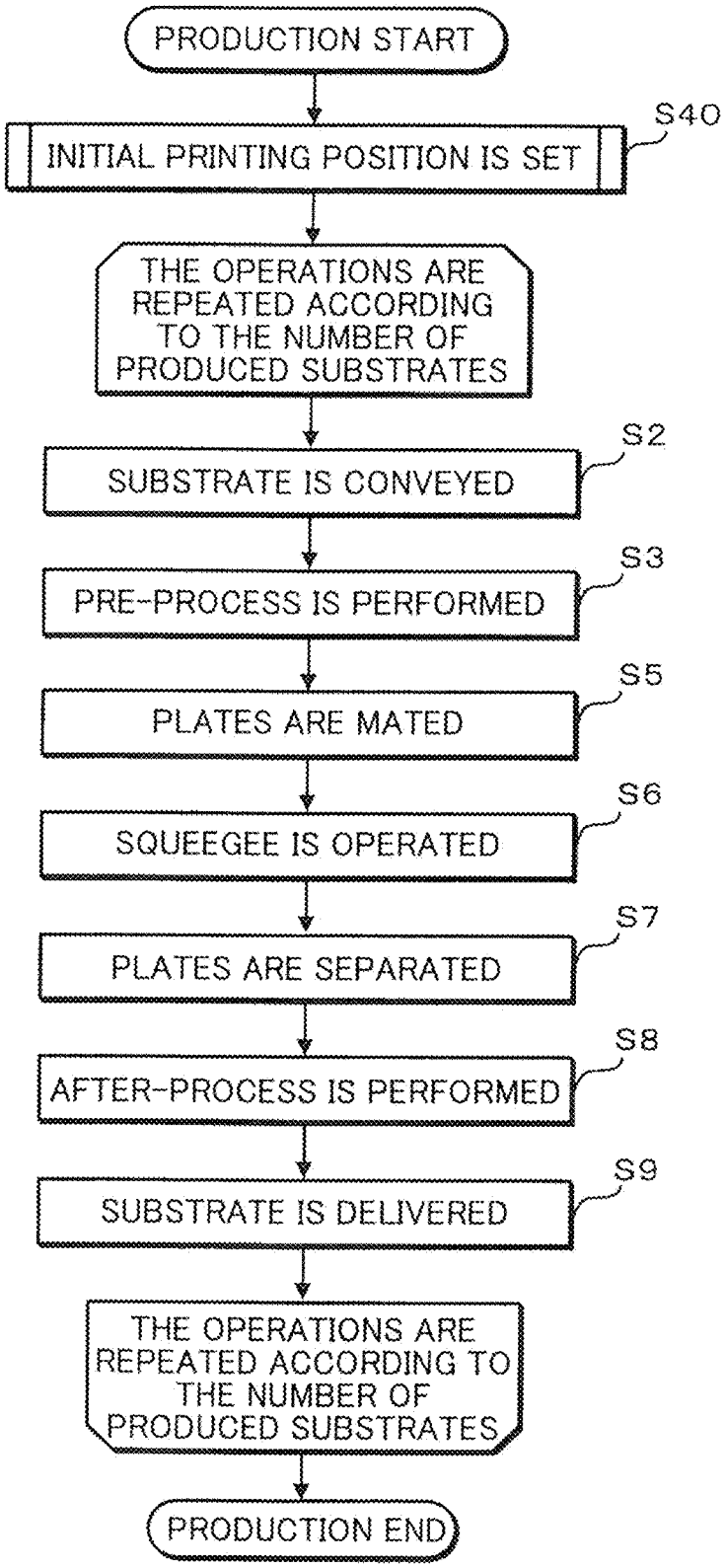
FIG. 22 is a flowchart illustrating the production flow in the second embodiment of the present invention.

Meanwhile, in the above-described production flow shown in FIG. 16, the adjustment of the printing position SP1 (SP2) is set by the operation position of the pre-process, but can be also set on the basis of the operation position of the after-process. A cleaning process is such an example as an after-process, where the substrate support table 10A (10B) moves, and the cleaning head of the cleaning unit (not shown in the figure) that is disposed on the substrate support table 10A (10B) removes the excess cream solder that has adhered to the lower surface of the screen mask, thereby cleaning the screen mask. The movement amount of the substrate support table 10A (10B) and the movement start position are changed each time the product number is changed. Accordingly, in the flowchart shown in FIG. 22, the printing position is initially set with reference to the after-process, instead of the initial printing position subroutine S1 and the printing position adjustment processing subroutine S30 (step S40).

Figure 23:
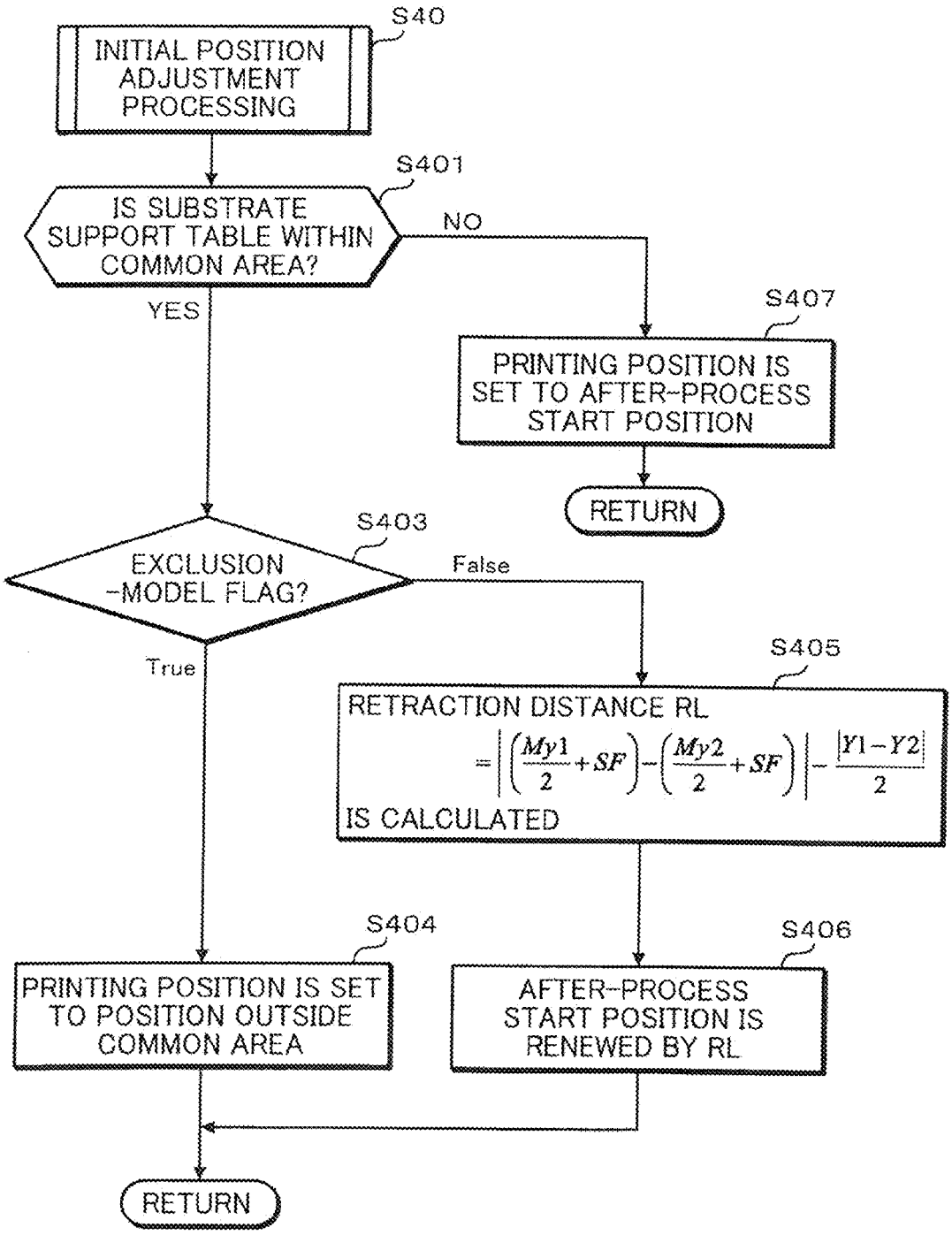
FIG. 23 is a flowchart illustrating another initial printing position setting subroutine in FIG. 22.
Figure 24:
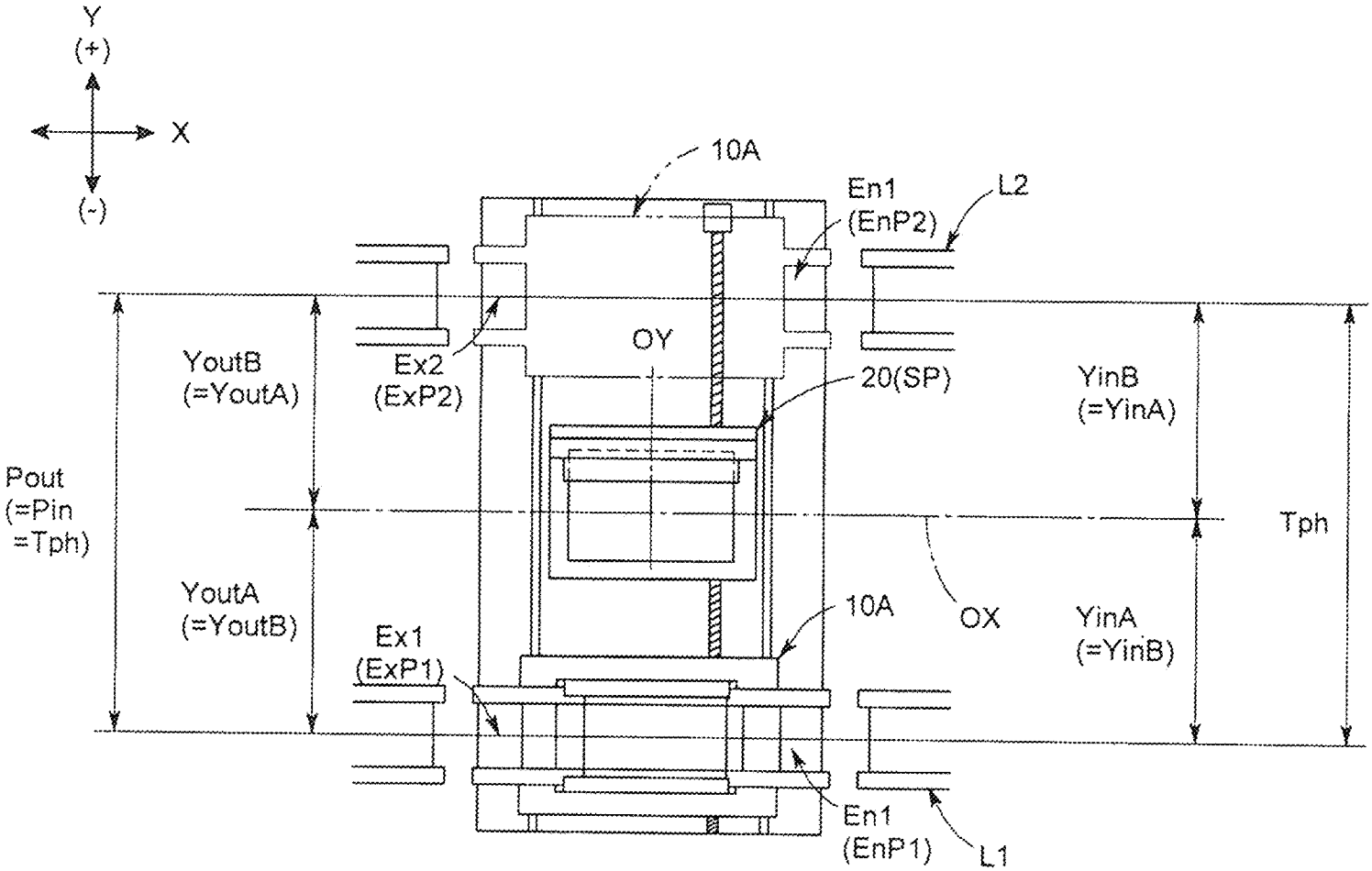
FIG. 24 is a simplified plan view illustrating another embodiment of the present invention.
Figure 25:
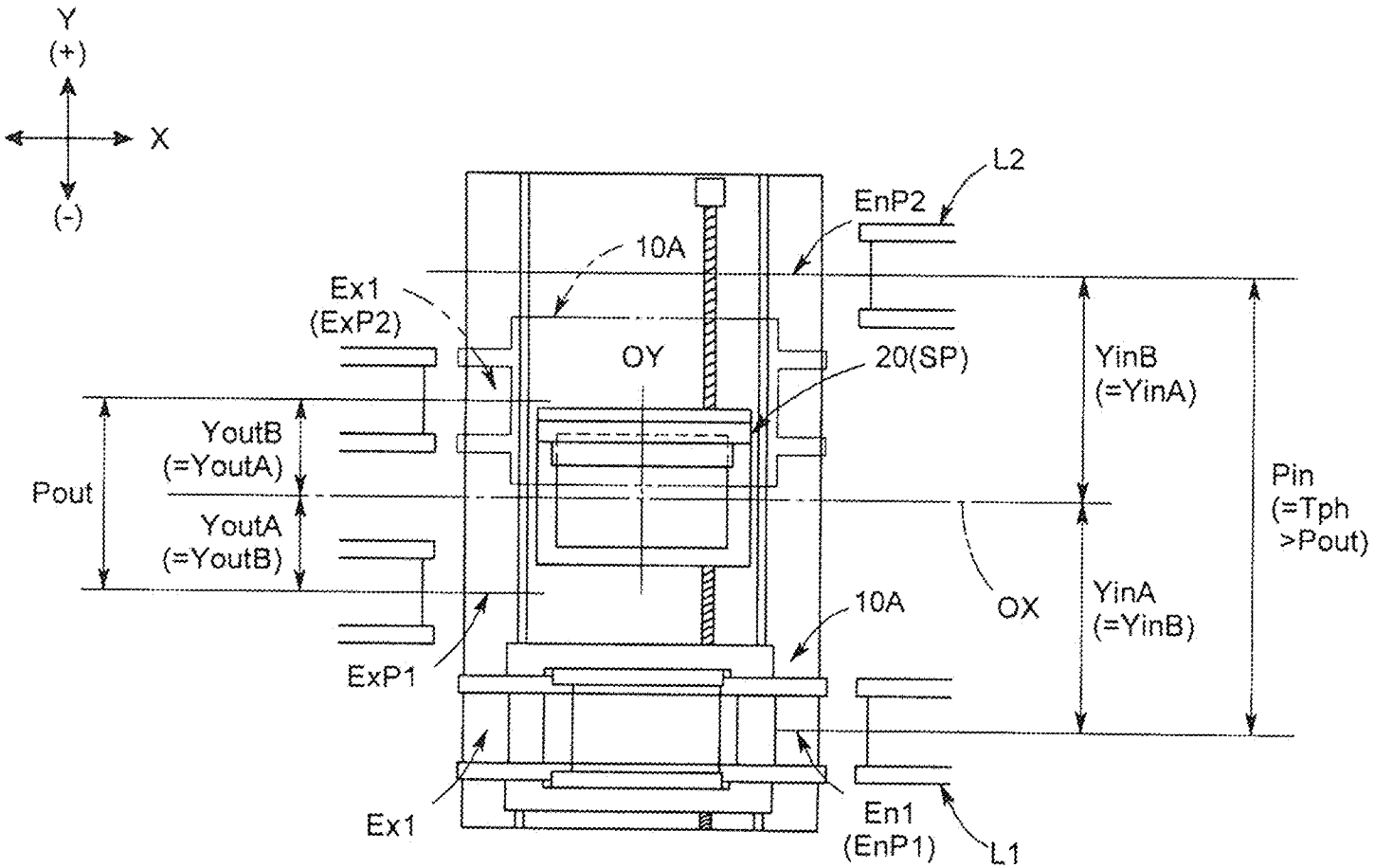
FIG. 25 is a simplified plan view illustrating yet another embodiment of the present invention.
Figure 26:
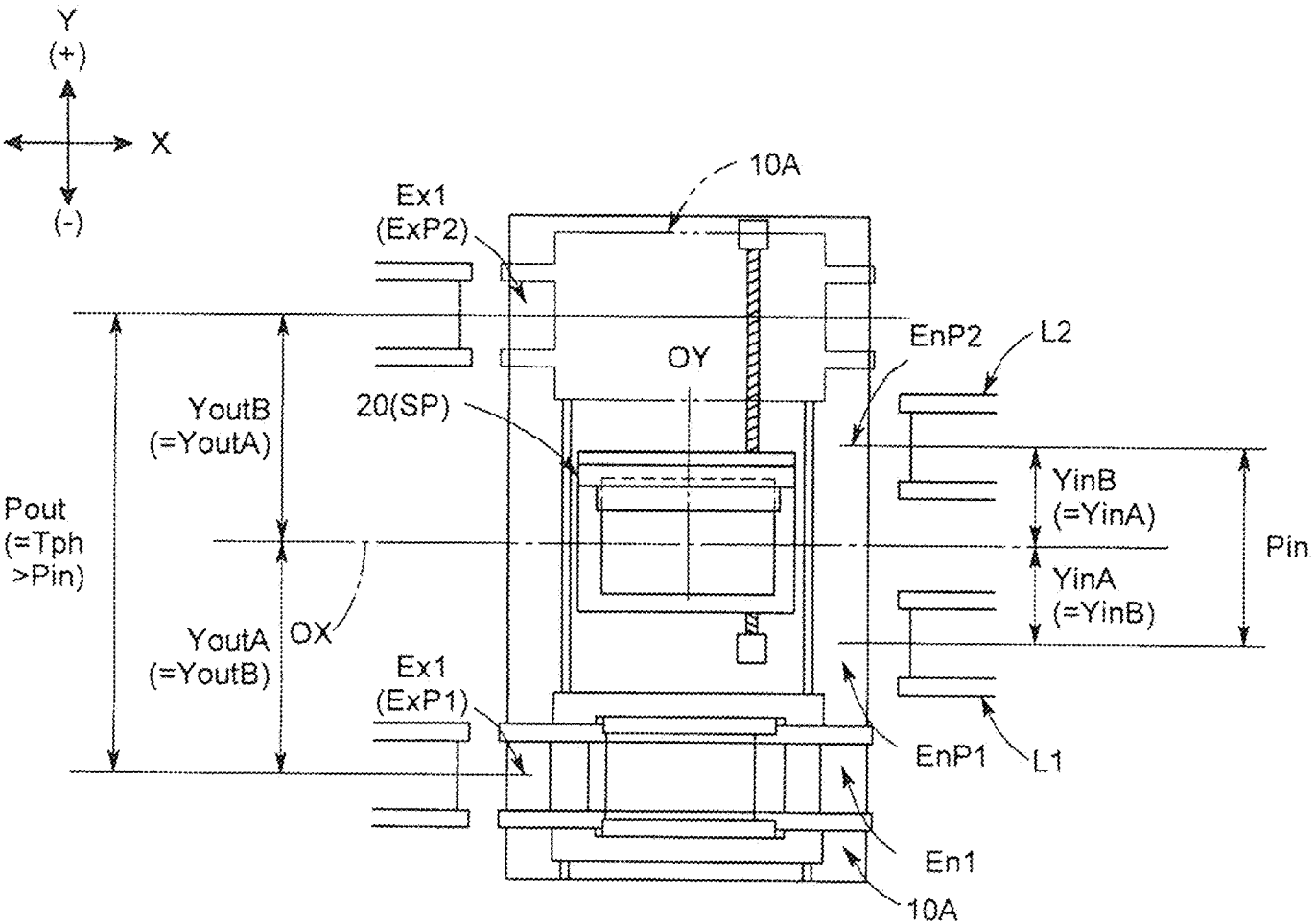
FIG. 26 is a simplified plan view illustrating yet another embodiment of the present invention.
Figure 27:
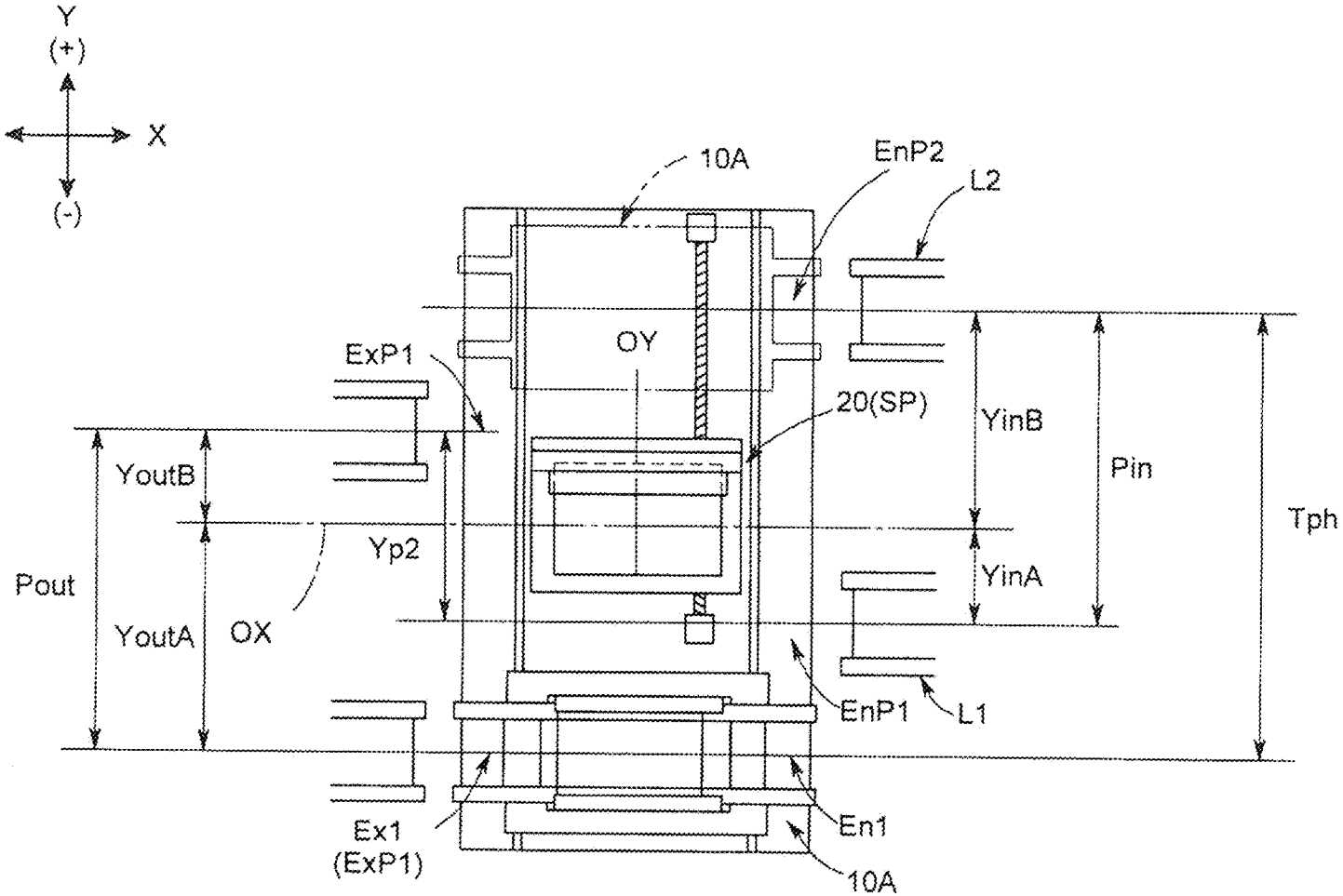
FIG. 27 is a simplified plan view illustrating yet another embodiment of the present invention.

Referring to FIG. 23, in the initial printing position setting subroutine S40 shown in the same figure, when the after-process is started, it is determined whether or not it is necessary to move into the common area (step S401), and where the movement is determined to be necessary, it is determined whether or not the value of EXCLUSION-MODEL FLAG is TRUE (step S403).

Where the value of EXCLUSION-MODEL FLAG is TRUE, the printing position SP1 (SP2) cannot be set to the common area. Therefore, the control unit 60 retracts the printing execution unit in the direction of withdrawal from the other printing execution unit 20B (20A), sets the printing position SP1 (SP2) outside the common area on the substrate conveying paths PH1 (PH2), and returns to the main routine (step S404).

Meanwhile, where the value of EXCLUSION-MODEL FLAG is FALSE, the control unit 60 calculates the retraction distance RL on the basis of equation (1) (step S405). Then, the control unit 60 renews the coordinate at which the substrate support table 10A (10B) starts the after-process on the substrate conveying paths PH1 (PH2) on the basis of the retraction distance RL and sets the corrected coordinate as the printing position coordinate (step S406). As a result of this processing, the substrate support table 10A (10B) can be transferred to the after-process by moving from the printing position at which the interference can be avoided, and the loss caused by undesirable routes can be avoided as much as possible.

Meanwhile, when the after-process start position of the substrate support table 10A (10B) is determined in step S401 to be outside the common area, the control unit 60 sets the pre-process end position as the printing position (step S407). As a result, the after-process on the substrate support table 10A (10B) can be immediately started from the position at which the printing process has ended, and the loss caused by undesirable routes can be avoided as much as possible.

As described hereinabove, in the present embodiment, a screen printing apparatus 1 is provided in which the substrates W conveyed along a predetermined conveying direction that follows the X axis direction are conveyed from the substrate entry positions EnP1 and EnP2, screen printing is performed on the substrates, and the substrates W after the printing are delivered from substrate exit positions ExP1 and ExP2 that are set on a downstream side in the conveying direction. The screen printing apparatus includes: printing execution units 20A and 20B that perform screen printing on the substrates W; at least one substrate support table 10A, 10B adapted to move along the Y axis direction serving as a specific direction orthogonal to the conveying direction, which is along the X axis direction, to holds the substrates W conveyed from the substrate entry positions EnP1 and EnP2, to execute print-process at printing positions SP1, SP2 that are set by the printing execution unit 20A, 20B, and deliveries the substrates W after printing from the substrate exit positions ExP1 and ExP2; and a table drive mechanism 4A, 5A, 4B, 5B that moves the substrate support tables 10A and 10B at least from the substrate entry positions EnP1 and EnP2 to the substrate exit positions ExP1 and ExP2 along the Y axis direction in a reciprocating manner. The substrate entry positions EnP1 and EnP2 to the substrate exit positions ExP1 and ExP2 are set asymmetrically with respect to the apparatus center axis OY along the Y axis direction. Also the printing positions SP1, SP2 are set on the substrate conveying path PH needed for the substrate support tables 10A and 10B to move from the entry of the substrates W to the exit of the substrates W. Therefore, in the present embodiment, even though the substrate entry positions EnP1 and EnP2 and the substrate exit positions ExP1 and ExP2 are set asymmetrically with respect to the apparatus center axis OY along the Y axis direction, the printing process can be executed on the substrate conveying path PH needed for the substrate support tables 10A and 10B to move from the entry of the substrates W to the exit of the substrates W. According to the present embodiment, the movement distance is shorter than in the case where the printing positions SP1, SP2 are set to the center of the apparatus. As a consequence, the entire movement path of the substrate support tables 10A and 10B in the Y axis direction is shortened and a contribution can be made to the increase in throughput.

Furthermore, in the present embodiment, the printing positions SP1, SP2 are set to be shifted from the central position of the substrate conveying path PH in the substrate conveying path PH to either of two: a reception position at which the substrates W are received by the substrate support tables 10A and 10B from the substrate entry positions EnP1 and EnP2; and a delivery position at which the substrate support tables 10A and 10B deliver the substrates W to the substrate exit positions ExP1 and ExP2. As a result, in the present embodiment, the operation timing from the substrate entry positions EnP1 and EnP2 to the printing positions SP1, SP2 or the operation timing from the printing positions SP1, SP2 to the substrate exit positions ExP1 and ExP2 can be shortened as much as possible. Therefore, the throughput can be increased more advantageously.

Further, in the present embodiment, there are further provided the image capturing unit 50 serving as an example of a pre-process processing means or mechanism that executes a predetermined pre-process with respect to the substrates W supported on the substrate support tables 10A and 10B by moving the substrate support tables 10A and 10B in the Y axis direction prior to the printing process, and the control unit 60 serving as a printing position setting section that controls the printing execution unit drive mechanism so as to set the printing positions SP1, SP2 between the stop positions of the substrate support tables 10A and 10B assumed when the pre-process is ended and the substrate exit positions ExP1 and ExP2. Therefore, in the present embodiment, when various pre-processes are implemented by moving the substrate support tables 10A and 10B in the Y axis direction prior to the printing process, the printing positions SP1, SP2 are set between the stop positions of the substrate support tables 10A and 10B assumed when the pre-process is ended and the substrate exit positions ExP1 and ExP2. Therefore, the substrates W to be transferred to the printing process can be transferred to the printing process, without moving in the direction opposite to the carry-out direction from the stop positions of the substrate support tables 10A and 10B. Further, the substrates W after the printing process can be carried out without moving in the direction reversed with respect to the substrate exit positions ExP1 and ExP2. Therefore, the loss caused by the undesirable routes from the pre-process to the delivery operation can be eliminated.

In the present embodiment, the control unit 60 sets the stop positions of the substrate support tables 10A and 10B assumed when the pre-process is ended to the printing positions SP1, SP2. Therefore, in the present embodiment, the substrate support tables 10A and 10B can be stopped and a transition can be made to the printing process at a timing in which the pre-process has ended. As a consequence, the substrates W after the pore-process cannot be displaced by the subsequent movement thereof. The resultant advantage is that the substrates W and the screen masks are accurately positioned in the printing process.

Further, in the present embodiment, there are further provided an after-process processing mechanism (image capturing unit 50 and the like) that executes a predetermined after-process by moving the substrate support tables 10A and 10B in the Y axis direction after the printing process, and the control unit 60 that controls the printing execution unit drive mechanism so as to set the printing positions SP1, SP2 to positions of the substrate support tables 10A and 10B assumed when the after-process processing mechanism starts the after-process. Therefore, in the present embodiment, when the after-process is implemented, the printing positions SP1, SP2 are set to the positions of the substrate support tables 10A and 10B assumed when the after-process is started by moving the substrate support tables 10A and 10B in the Y axis direction after the printing process. Therefore, the substrates W to be transferred to the after-process can be transferred to the after-process immediately, without moving in the direction opposite to the carry-out direction from the printing positions SP1, SP2. As a consequence, the loss caused by the undesirable routes from the printing process to the delivery operation can be eliminated.

Further, in the present embodiment, a printing execution unit drive mechanism is provided to drive the printing execution units 20A and 20B along the Y axis direction and has the Y axis servo motor 210 as the principal component. Therefore, in the present embodiment, the printing positions SP1, SP2 can be adjusted as necessary by moving the printing execution units 20A and 20B in the Y axis direction. As a result, the printing positions SP1, SP2 can be changed according to the layout of the substrate entry positions EnP1 and EnP2 or substrate exit positions ExP1 and ExP2, or operation mode of the substrate support tables 10A and 10B, and the printing process can be implemented with even higher efficiency.

Further, in the present embodiment, the substrate support tables 10A and 10B are arranged side by side in the Y axis direction and form a pair; the printing execution units 20A and 20B are provided to form pairs with corresponding a pair of substrate support tables 10A and 10B; the drive mechanism of the substrate support tables 10A and 10B drives the pair of the substrate support tables 10A and 10B individually; and at least one of the substrate entry positions EnP1 and EnP2 and the substrate exit positions ExP1 and ExP2 is a pair. In the present embodiment, at least one of the substrate support tables 10A and 10B and the printing execution units 20A and 20B is provided in a set of two, so that the throughput can be increased. As a consequence, sufficient processing capacity (throughput) can be demonstrated even in a manufacturing line of a dual conveying model in which at least one of the upstream side and downstream side of the screen printing apparatus has two conveying lines for substrates W.

In the present embodiment, the control unit 60 also functions as a printing execution unit drive mechanism that drives individually the pair of printing execution units 20A and 20B and sets the printing positions SP1, SP2 for each corresponding substrate support table 10A, 10B.

In the present embodiment, a common area is set where either of the printing execution units 20A and 20B can go to enter along the Y axis direction; and the control unit 60 controls the printing execution unit drive mechanism so as to renew the printing positions SP1, SP2 that are set for at least either of the printing execution units 20A and 20B when the interference of the two printing execution units 20A and 20B has been predicted to occur in the concurrent movement of the pair of printing execution units 20A and 20B. Therefore, in the present embodiment, when the upcoming interference has been predicted, the control unit 60 controls the printing execution unit drive mechanism so as to renew the printing positions SP1, SP2 that are set for at least either of the printing execution units 20A and 20B. As a result, the pair of printing execution units 20A and 20B can perform the printing process concurrently, while avoiding the interference, even when a common area is set.

In the present embodiment, the control unit 60 sets the printing positions SP1, SP2 such that both of the pair of printing execution units 20A and 20B are retracted through a retraction distance obtained by dividing in halves an opposing distance WL at which interference can be avoided when the potential interference has been predicted. Therefore, in the present embodiment, when the pair of printing execution units 20A and 20B is to move into the common area at the same time, the opposing distance WL therebetween for avoiding interference is divided in halves. As a consequence, the retraction operation is equally distributed between the two printing execution units 20A and 20B and the retraction processing can be executed without a disproportionate distribution of retraction time.

Figure 28:
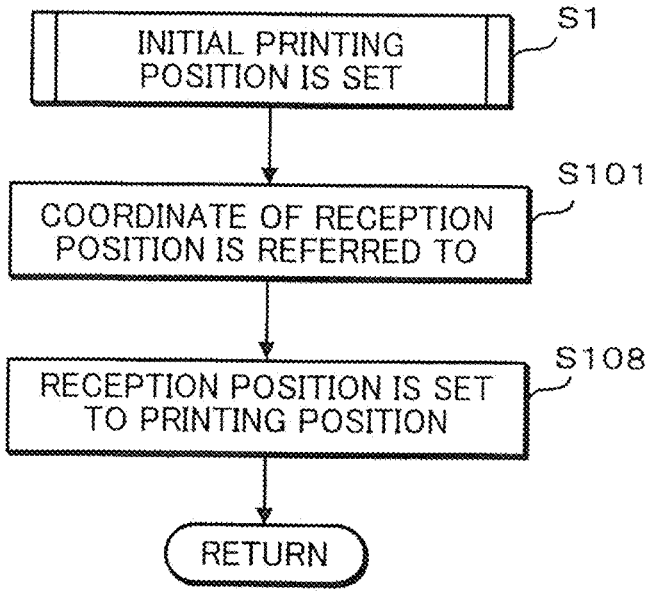
FIG. 28 is a flowchart illustrating the printing position adjusting processing subroutine applicable to the embodiments shown in FIGS. 24 to 27.
Figure 29:
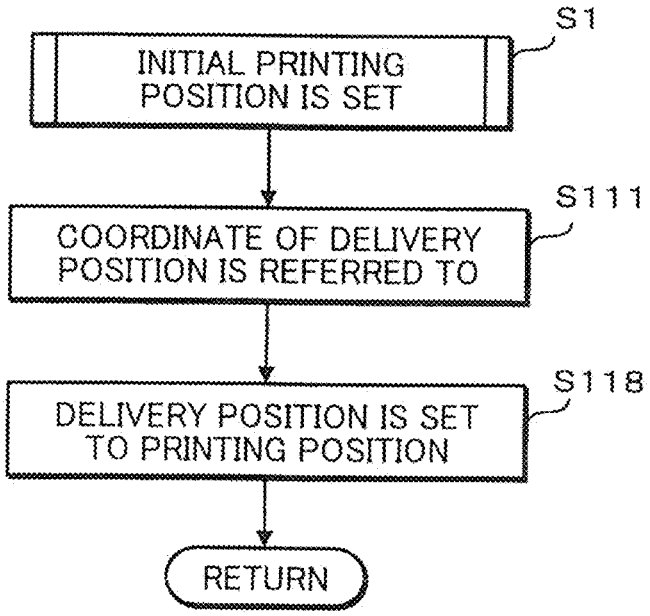
FIG. 29 is a flowchart illustrating another printing position adjusting processing subroutine applicable to the embodiments shown in FIGS. 24 to 27.

As shown in FIGS. 24 to 27, the present invention can be similarly applied even in the case of the screen printing apparatus 1 provided with one substrate support table and one printing execution unit. In this case, the aforementioned concept of "interference" goes away. Therefore, when subroutines illustrated by FIGS. 17, 18, and 23 are used, only steps S101, S108 (or steps S111, S118) may be executed as shown in FIGS. 28 and 29, or only step S407 may be executed as shown in FIG. 23.

Further, when step S307 shown in FIG. 19 or 21 is executed, the printing position can be set as shown in FIG. 20 and the loss caused by the undesirable routes can be eliminated.

As described hereinabove, the present invention demonstrates the following remarkable effect: although the substrate entry position and the substrate exit position are set asymmetrically with respect to the apparatus center line OY that follows the Y axis direction, the printing process can be executed on the conveying path of the substrate needed for conveying the substrate W. Therefore, the entire path of the substrate support table 10A (10B) in the Y axis direction can be shortened and a contribution can be made to the increase in throughput.

The above-described screen printing apparatus 1 exemplifies the preferred embodiment of the present invention, and the specific configuration thereof can be changed as appropriate without departing from the essence of the present invention.

More specifically, a configuration in which a transfer belt conveyor pair is provided in the substrate entry unit En1 and the second substrate entry unit Ent may be used for carrying in or carrying out the substrate W in the screen printing apparatus 1 (this configuration is not shown in the figures). The advantage of such configuration is that the alignment of the belt conveyor pairs CL, CL2 of the first and second loaders L1 and L2 and the belt conveyor pairs 12A and 12B corresponding to the first and second substrate support tables 10A and 20A is determined mechanically and therefore the control is facilitated.

Likewise, the configuration provided with a transfer belt conveyor pair at the substrate exit unit Ex1 and the second substrate exit unit Ex2 may be also used.

It is also possible to provide a transfer conveyor only in either of the substrate entry unit and the substrate exit unit.

Further, the specific support structure of the substrate W in the substrate support table 10A and the like, the specific holding structure of the screen mask 206 in the printing section unit 20 and the like, and the specific structure of the squeegee unit holding mechanism 400 are not necessarily limited to those of the screen printing apparatus 1 of the above-described embodiment.

Figure 30:
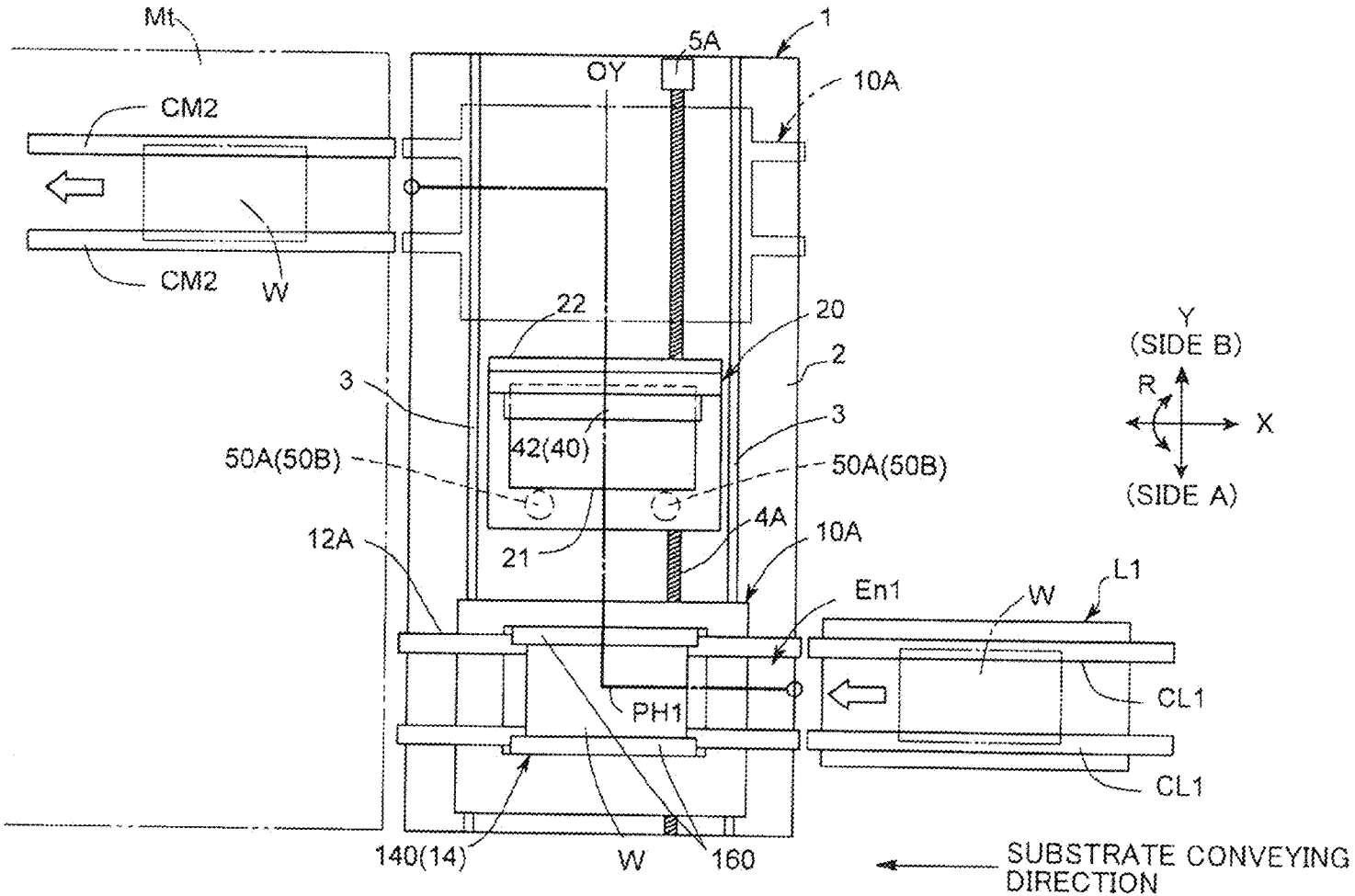
FIG. 30 is a simplified plan diagram illustrating yet another embodiment of the present invention.

Further, where the substrate entry and exit positions are set asymmetrically with respect to the center axis OY extending along the Y axis direction of the screen printing apparatus 1, the substrate entry and exit positions may be both in a single lane, for example, as shown in FIG. 30.

Further, the final stop position in the pre-process and the movement start position in the after-process may be determined by the movement of the printing execution units 20A and 20B, which is the relative movement of the substrate support tables 10A and 10B and the printing execution units 20A and 20B.

It goes without saying that a variety of design changes can be made without departing from the scope of the present invention.

Thus, the present invention provides a screen printing apparatus that receives a substrate conveyed along a predetermined conveying direction from a substrate entry position, screen prints on the substrate, and delivers the substrate after the printing from a substrate exit position that is set on a downstream side in the conveying direction, the screen printing apparatus including: a printing execution unit that performs screen printing on the substrate; at least one substrate support table adapted to move along a specific direction orthogonal to the conveying direction, to hold the substrate conveyed from the substrate entry position, to execute print-process at a printing position that is set by the printing execution unit, and to deliver the substrate after printing from the substrate exit position; and a table drive mechanism that moves the substrate support table at least from the substrate entry position to the substrate exit position along the specific direction in a reciprocating manner, wherein the substrate entry and exit positions are set asymmetrically with respect to an apparatus center axis along the specific direction; a printing execution unit drive mechanism is provided to drive the printing execution unit along the specific direction; and a control unit is provided to control the printing execution unit drive mechanism so that the printing execution unit is driven to set the printing position on a substrate conveying path needed for the substrate support table to move from the substrate entry to the substrate exit. In this configuration, even though the substrate entry position and substrate exit position are set asymmetrically with respect to the apparatus center line along the specific direction, the printing process can be executed on the substrate conveying path needed for the substrate support table to move from the substrate entry position to the substrate exit position. Therefore, the movement distance is shorter than in the case where the printing position is arranged at the center of the apparatus. As a consequence, the entire movement path of the substrate support table in the specific direction is shortened and a contribution can be made to the increase in throughput. Furthermore, the printing position can be adjusted as necessary by moving the printing execution unit in the specific direction. As a result, the printing position can be changed according to the layout of substrate entry position or substrate exit position, or operation mode of the substrate support table, and the printing process can be implemented with higher efficiency.

In the preferred configuration, the control unit controls the printing execution unit drive mechanism so that the printing position set to a position shifted from a central position of the substrate conveying path to one of a reception position at which the substrate is received by the substrate support table from the substrate entry position and a delivery position at which the substrate support table delivers the substrate to the substrate exit position, with respect to the substrate conveying path. In such configuration, the operation timing from the substrate entry position to the printing position or the operation timing from the printing position to the substrate exit position can be shortened as much as possible and, therefore, the throughput can be increased more advantageously.

In the preferred configuration, a pre-process processing mechanism is further provided that executes a predetermined pre-process with respect to the substrate supported on the substrate support table by moving the substrate support table and the printing execution unit relative to each other in the specific direction prior to the printing process, wherein the control unit controls the printing execution unit drive mechanism so as to set the printing position between a stop position of the substrate support table assumed when the pre-process processing mechanism ends the pre-process and the substrate exit position. In such configuration, the printing position is set between a stop position of the substrate support table assumed when the pre-process processing mechanism ends the pre-process and the substrate exit position prior to the printing process. Therefore, the substrate to be transferred to the printing process can be transferred to the printing process, without moving in the direction opposite to the carry-out direction from the stop position of the substrate support table. Further, the substrate after printing can be carried out without moving in the direction reversed with respect to the substrate exit position. Therefore, the loss caused by the undesirable routes from the pre-process to the delivery operation can be eliminated. The "pre-process" as referred to herein may be, for example, a "mark recognition" process of recognizing an indicator that has been set on the substrate. The pre-process also may be a "bad mark recognition" process of recognizing a defect mark that has been set on any of multiple-patterned substrates that are separated after component mounting. Alternatively, the pre-process may be a "foreign matter inspection" process of inspecting foreign matter that has adhered to the substrate. Further, a position "between the stop position of the substrate support table and the substrate exit position" can be set in various zones within a range in which the conveying path of the substrate does not turn back. For example, when the cleaning processing is implemented by shifting the substrate support table and the printing execution unit relative to each other after the printing process, the printing position may be set to the start position of the cleaning processing.

In the preferred configuration, the control unit controls the printing execution unit drive mechanism so that the printing position is set to the stop position of the substrate support table assumed when the pre-process processing mechanism ends the pre-process. In this configuration, the substrate support table can be stopped and a transition can be made to the printing process at a timing in which the pre-process has ended. Therefore, the substrate after the pre-process cannot be displaced by the subsequent movement thereof. The resultant advantage is that the substrate and the screen mask are accurately positioned in the printing process.

In the preferred configuration, an after-process processing mechanism is provided that executes a predetermined after-process by moving the substrate support table and the printing execution unit relative to each other in the specific direction after the printing process, wherein the control unit controls the printing execution unit drive mechanism so as to set the printing position to a position of the substrate support table assumed when the after-process processing mechanism starts the after-process. With such configuration, when the after-process is implemented, the printing position is set to the position of the substrate support table assumed when the after-process is started. Therefore, the substrate to be transferred to the after-process can be transferred to the after-process immediately, without moving in the direction opposite to the carry-out direction from the printing position. Therefore, the loss caused by the undesirable routes from the printing process to the delivery operation can be eliminated. The "after-process" as referred to herein may be a "cleaning processing" process of cleaning the superposition surface of the screen mask after the printing process. Alternatively, the after-process may be an "after-printing inspection" process of inspecting the printing state on the substrate after the printing.

In the preferred configuration, the substrate support tables are arranged side by side in the specific direction to from a pair; the printing execution unit is adapted to set individually a pair of the printing positions provided for each of the pair of the substrate support tables; the table drive mechanism is adapted to drive the pair of the substrate support tables individually; the printing execution unit drive mechanism is adapted to drive the pair of printing execution units individually; the control unit is adapted to set the printing position for each printing execution unit; and at least one of the substrate entry position and the substrate exit position is provided in a set of two. With such configuration, the substrate support tables and printing execution units are provided in sets of two and the throughput can be increased. Therefore, sufficient processing capacity (throughput) can be demonstrated even in a manufacturing line of a dual conveying model in which at least either of the upstream side and downstream side of the screen printing apparatus has two substrate conveying lines.

In the preferred configuration, a common area is set where either of the printing execution units enables to enter along the specific direction, the control unit includes: a predicting section that predicts a potential interference of the two printing execution units during concurrent movement of the pair of printing execution units; and a printing position setting section that controls the printing execution unit drive mechanism so as to renew the printing position that is set for at least one of the pair of printing execution units when the potential interference has been predicted. In such configuration, when the potential interference has been predicted, the printing position setting section controls the printing execution unit drive mechanism so as to renew the printing position that is set for at least either of the printing execution units. As a result, the pair of printing execution units can perform the printing process concurrently, while avoiding interference, even when a common area is set.

In the preferred configuration, the printing position setting section controls the printing execution unit drive mechanism so as to set the printing position such that both of the pair of printing execution units are retracted by a retraction distance obtained by dividing in halves an opposing distance at which interference can be avoided when the potential interference has been predicted. In such configuration, when the pair of printing execution units is to move into the common area at the same time, the opposing distance therebetween for avoiding interference is divided in halves. Therefore, the retraction operation is equally distributed between the two printing execution units and the retraction processing can be executed without a disproportionate distribution of retraction time.

This application is based on Japanese Patent application No. 2011-122926 filed in Japan Patent Office on May 31, 2011, the contents of which are hereby incorporated by reference.

As described hereinabove, the present invention demonstrates the following remarkable effect: although the substrate entry and exit positions are set asymmetrically with respect to the apparatus center line that follows a specific direction, the printing process can be executed on the conveying path of the substrate. Therefore, the entire movement path of the substrate support table in the specific direction can be shortened and a contribution can be made to the increase in throughput.

What is claimed is:

1. A screen printing apparatus receiving a substrate conveyed along a predetermined conveying direction from a substrate entry position, screen printing on the substrate, and delivering the substrate after screen printing from a substrate exit position that is set on a downstream side in the predetermined conveying direction, the substrate entry position and the substrate exit position being set asymmetrically with respect to an apparatus center axis along a specific direction orthogonal to the predetermined conveying direction, the screen printing apparatus comprising:

at least one printing execution unit including a screen mask, the printing execution unit configured to perform screen printing on the substrate and setting a printing position;

at least one substrate support table configured to move along the specific direction, to hold the substrate conveyed from the substrate entry position, to execute print-process at the printing position that is set by the printing execution unit, and to deliver the substrate after printing from the substrate exit position;

a table drive mechanism configured to move the substrate support table at least from the substrate entry position to the substrate exit position along the specific direction in a reciprocating manner;

a printing execution unit drive mechanism configured to drive the printing execution unit along the specific direction; and a control unit configured to control the printing execution unit drive mechanism so that the printing execution unit including the screen mask is driven in order to set the printing position on a substrate conveying path needed for the substrate support table to move from the substrate entry to the substrate exit.

2. The screen printing apparatus according to claim 1, wherein the control unit controls the printing execution unit drive mechanism so that the printing position set to a position shifted from a central position of the substrate conveying path to one of a reception position at which the substrate is received by the substrate support table from the substrate entry position and a delivery position at which the substrate support table delivers the substrate to the substrate exit position, with respect to the substrate conveying path.

3. The screen printing apparatus according to claim 1, further comprising a pre-process processing mechanism that executes a predetermined pre-process with respect to the substrate supported on the substrate support table by moving the substrate support table and the printing execution unit relative to each other in the specific direction prior to the printing process, wherein the control unit controls the printing execution unit drive mechanism so as to set the printing position between a stop position of the substrate support table assumed when the pre-process processing mechanism ends the pre-process and the substrate exit position.

4. The screen printing apparatus according to claim 3, wherein the control unit controls the printing execution unit drive mechanism so that the printing position is set to the stop position of the substrate support table assumed when the pre-process processing mechanism ends the pre-process.

5. The screen printing apparatus according to claim 1, further comprising an after-process processing mechanism that executes a predetermined after-process by moving the substrate support table and the printing execution unit relative to each other in the specific direction after the printing process, wherein the control unit controls the printing execution unit drive mechanism so as to set the printing position to a position of the substrate support table assumed when the after-process processing mechanism starts the after-process.

6. The screen printing apparatus according to claim 1, further comprising a second substrate support table and a second printing execution unit;

wherein:

said at least one substrate support table and said second substrate table form a pair of substrate support tables that are arranged side by side in the specific direction;

said at least one printing execution unit and said second printing execution unit form a pair of printing execution units; said pair of printing execution units are configured to individually set the printing position for the pair of substrate support tables;

the table drive mechanism is configured to individually drive the pair of substrate support tables;

the printing execution unit drive mechanism is configured to individually drive the pair of printing execution units;

the control unit is configured to set the printing position for each of the pair of printing execution units; and at least one of the substrate entry position and the substrate exit position is provided in a set of two.

7. The screen printing apparatus according to claim 6, wherein a common area is set where either of the pair of printing execution units enables to enter along the specific direction, the control unit includes:

a predicting section that predicts a potential interference of the pair of printing execution units during concurrent movement of the pair of printing execution units; and a printing position setting section that controls the printing execution unit drive mechanism so as to renew the printing position that is set for at least one of the pair of printing execution units when the potential interference has been predicted.

8. The screen printing apparatus according to claim 7, wherein the printing position setting section controls the printing execution unit drive mechanism so as to set the printing position for each of the pair of substrate support tables such that both of the pair of printing execution units are retracted by a retraction distance obtained by dividing in halves an opposing distance at which interference can be avoided when the potential interference has been predicted.

* * * * *